US012654893B2

(12) United States Patent
Jovanovic

(10) Patent No.: US 12,654,893 B2
(45) Date of Patent: Jun. 16, 2026

(54) MAILER MACHINE FOR MULTIPLE, DIFFERENT MAILER CONFIGURATIONS AND METHOD OF USE

(71) Applicant: Intertape Polymer Corp., Sarasota, FL (US)

(72) Inventor: Bojan Jovanovic, Glen Ellyn, IL (US)

(73) Assignee: INTERTAPE POLYMER CORP., Sarasota, FL (US)

( * ) Notice: Subject to any disclaimer, the term of this patent is extended or adjusted under 35 U.S.C. 154(b) by 0 days.

(21) Appl. No.: 18/581,338

(22) Filed: Feb. 19, 2024

(65) Prior Publication Data

US 2024/0270426 A1 Aug. 15, 2024

Related U.S. Application Data

(63) Continuation of application No. 17/564,755, filed on Dec. 29, 2021, now Pat. No. 11,905,057.
(Continued)

(51) Int. Cl.
*B65B 43/46* (2006.01)
*B65B 7/08* (2006.01)
(Continued)

(52) U.S. Cl.
CPC ..... *B65B 43/46* (2013.01); *B65B 7/08* (2013.01); *B65B 43/44* (2013.01); *B65B 57/02* (2013.01)

(58) Field of Classification Search
CPC ..... B65B 43/46; B65B 43/44; B65B 43/62; B65B 59/001; B65B 59/003; B65B 7/08; B65B 57/02; B65B 2210/04
See application file for complete search history.

(56) References Cited

U.S. PATENT DOCUMENTS 1,625,057 A 4/1927 Schnur et al.
4,951,445 A * 8/1990 Thibault ..... B25J 15/0052 53/251
(Continued)

FOREIGN PATENT DOCUMENTS

CN 108945614 A 12/2018
DE 102011001127 A1 9/2012
(Continued)

OTHER PUBLICATIONS

International Bureau of WIPO; International Preliminary Report on Patentability for International Application No. PCT/US2020/052762 dated Apr. 7, 2022, 7 Pages.
(Continued)

*Primary Examiner* — Thomas M Wittenschlaeger
(74) *Attorney, Agent, or Firm* — Jeffrey R. Gray; Moore & Van Allen PLLC

(57) ABSTRACT

A mailer machine including a mailer supply station (e.g., a rotary mailer supply station, a linear mailer supply station, a non-linear mailer supply station, or the like) and a handling station operatively coupled to the mailer supply station. The mailer supply station provides, on a selective basis, mailers having different attributes. The mailer supply station of the mailer machine provides for movement of magazines with respect to a robot in the handling station that may have a distal end secured in a stationary and fixed location. As such, different magazines with dissimilar mailers may be moved to a picking location adjacent the robot, as dissimilar mailers are required. Further, the mailers within the magazines may be moved to a pre-determined pick-up location such that the robot is repeatably picking a mailer from the pre-determine pick-up location.

19 Claims, 23 Drawing Sheets

Related U.S. Application Data

(60) Provisional application No. 63/132,237, filed on Dec. 30, 2020.

(51) Int. Cl.
*B65B 43/44* (2006.01)
*B65B 57/02* (2006.01)

(56) References Cited

U.S. PATENT DOCUMENTS

| | | | |
|---|---|---|---|
| 5,002,267 | A | 3/1991 | Brecy |
| 5,354,170 | A | 10/1994 | Schweingruber et al. |
| 5,515,664 | A | 5/1996 | Tanaka et al. |
| 5,536,231 | A | 7/1996 | Nilsson |
| 5,653,087 | A | 8/1997 | Spada et al. |
| 5,911,252 | A | 6/1999 | Cassel |
| 7,569,009 | B2 | 8/2009 | Monti |
| 8,056,200 | B2 | 11/2011 | Hesse et al. |
| 8,083,659 | B2 | 12/2011 | Monti |
| 8,621,831 | B2 | 1/2014 | Moylan et al. |
| 10,137,656 | B2 | 11/2018 | Lundgren et al. |
| 10,173,329 | B2 | 1/2019 | Christiansen |
| 10,279,941 | B2 | 5/2019 | Hansen |
| 10,556,713 | B2 | 2/2020 | Langen |
| 10,703,063 | B2 | 7/2020 | Heath et al. |
| 2006/0117714 | A1 | 6/2006 | Draghetti |
| 2007/0072755 | A1 | 3/2007 | Monti |
| 2007/0132170 | A1 | 6/2007 | Butler |
| 2007/0245689 | A1 | 10/2007 | Lubezny |
| 2010/0170202 | A1 | 7/2010 | Bray et al. |
| 2014/0157725 | A1 | 6/2014 | Lena |
| 2014/0179501 | A1 | 6/2014 | Akama et al. |
| 2016/0121633 | A1 | 5/2016 | Tanisaki |
| 2018/0043650 | A1 | 2/2018 | Heath et al. |
| 2018/0222608 | A1 | 8/2018 | Hutter et al. |
| 2021/0094716 | A1 | 4/2021 | Showman et al. |
| 2021/0237385 | A1 | 8/2021 | Fridolfsson |

FOREIGN PATENT DOCUMENTS

| | | | |
|---|---|---|---|
| GB | 1493917 | A | 11/1977 |
| JP | 2001122460 | A | 5/2001 |
| JP | 2019064592 | A | 4/2019 |

OTHER PUBLICATIONS

European Patent Office; International Search Report and Written Opinion for International Patent Application No. PCT/US2020/052762 dated Jan. 20, 2021, 39 Pages.

* cited by examiner

*FIG.* 19

MAILER MACHINE FOR MULTIPLE, DIFFERENT MAILER CONFIGURATIONS AND METHOD OF USE

CROSS-REFERENCE TO RELATED APPLICATIONS

This application is a continuation of U.S. patent application Ser. No. 17/564,755, filed on Dec. 29, 2021, which claims priority to U.S. Provisional Application No. 63/132,237, filed on Dec. 30, 2020, both entitled "Mailer Machine for Multiple, Different Mailer Configurations and Methods of Use," the entirety of each of which is incorporated herein by reference.

FIELD

The present disclosure relates generally to a packaging machine. More specifically, a mailer machine that accurately and efficiently selects mailers with different attributes (e.g., different sizes, configurations, or the like) and packages the mailers with products having different attributes.

BACKGROUND

A mailer machine is a type of packaging machine that uses automation to select mailers that are filled with a product, such as a food, supplement, pharmaceutical, consumer item, or other goods. A conventional machine includes a mailer supply having mailers of the same attributes (e.g., size, configuration, or the like). Many conventional mailer machines operate in-line, pulling mailers from a single location and sending the mailer through opening and flap folding sections of the machine. These machines can only handle processing of a single mailer at a time and must be re-arranged off-line to handle a different configuration of mailers and/or products.

BRIEF SUMMARY

Embodiments of the invention comprise an improved mailer machine (otherwise described herein as a mailer apparatus, mailer packaging apparatus, or the like). The mailer machine includes a mailer supply station (e.g., a rotary mailer supply station, a linear mailer supply station, a non-linear mailer supply station, or the like) and a handling station operatively coupled to the mailer supply station. The mailer supply station provides, on a selective basis, mailers, in some applications, mailer blanks, pre-formed mailers, or the like. It should be understood that a "mailer" is a package that has outer surfaces, edges, a closed end, at least one open end, in which a product can be inserted, the package can be closed (e.g., a mailer lip 110 may be folded and operatively coupled to an outer surface of the mailer to enclose the product in the packaging, open ends of the mailer may be scaled together, or the like). In some embodiments, the mailer may have two outer surfaces, two closed edges, and one closed end. Alternatively, the mailer may be required to be folded into a shape within the mailer machine. Moreover, the mailers may be made of any material such as paper, plastic, cardboard, or other like materials.

One embodiment of the disclosure is a mailer packaging apparatus comprising a handling station having a robot, and a mailer supply station having a plurality of magazines for a holding mailers. The plurality of magazines has a first magazine configured to hold a plurality of first mailers and a second magazine configured to hold a plurality of second mailers, and wherein the plurality of magazines are movable with respect to the robot. The robot is configured to pick the mailers from the plurality of magazines.

In further accord with embodiments of the mailer packaging apparatus, the mailer supply station comprises a rotating support. The plurality of magazines are operatively coupled to the rotating support, and the plurality of magazines rotate with respect the robot.

In other embodiments of the mailer packaging apparatus, the handling station is located adjacent the mailer supply station. The first magazine of the plurality of magazines of the mailer supply station is located in a picking location adjacent the robot of the handling station.

In still other embodiments of the mailer packaging apparatus, the handling station further comprises a mailer feeder mechanism. The mailer feeder mechanism is configured to move a mailer in the first magazine to a pre-determined pick-up position for the robot to pick the mailer from the first magazine.

In yet other embodiments of the mailer packaging apparatus, the mailer feeder mechanism comprises an elevator mechanism. The elevator mechanism elevates the plurality of first mailers in the first magazine such that the mailer moved to the pre-determined pick-up position is an upper most mailer in the first magazine.

In further accord with embodiments of the mailer packaging apparatus, the mailer feeder mechanism comprises a pick-up position sensor. The mailer feeder mechanism moves the mailer to the pre-determined pick-up position based on feedback from the pick-up position sensor.

In other embodiments, the mailer packaging apparatus further comprises a packaging station configured to receive the mailers and transfer the mailers between a product supply station and a closing station.

In still other embodiments of the mailer packaging apparatus, the packaging station comprises a plurality of mailer pockets. Each of the plurality of mailer pockets are configured to actuate from a mailer receipt position to a mailer open position in which the mailers are configured to receive a product.

In yet other embodiments of the mailer packaging apparatus, the plurality of mailer pockets each comprise a first pocket portion, a second pocket portion, and a pocket adjustment system operatively coupled to the first pocket portion or the second pocket portion. The first pocket portion moves relative to the second pocket portion to move the mailer pocket from the mailer receipt position to the mailer open position.

In further accord with embodiments of mailer packaging apparatus, the pocket adjustment system comprises a first slide operatively coupled to the first pocket portion, a second slide operatively coupled to the second pocket portion, one or more tracks operatively coupled to the first slide and the second slide, one or more drive members operatively coupled to the first slide and the second slide, and one or more drives operatively coupled to the one or more drive members. The one or more drives are configured to move the first pocket portion with respect to the second pocket portion.

In other embodiments, the mailer packaging apparatus further comprising a product supply station that supplies products to openings of the mailers.

In still other embodiments of the mailer packaging apparatus, the product supply station comprises one or more product receptacles, and a product positioning system operatively coupled to the one or more product receptacles. The product positioning system locates the products in the one or more receptacles before packaging in the mailers.

In yet other embodiments of the mailer packaging apparatus, the one or more receptacles comprise a first wall and a second wall. The product positioning system is configured to move the first wall or the second wall with respect to each other to locate the products in the one or more receptacles before packaging in the mailers.

In further accord with embodiments of the mailer packaging apparatus, the product supply station comprises a product packaging system. The product packing system comprises a product pusher, and one or more product pusher actuators operatively coupled to the product pusher. The one or more product actuators are configured to extend the product pusher to move the products to the mailers.

In other embodiments, the mailer packaging apparatus further comprises a mailer closing station that is configured to close an opening of the mailer after a product is inserted into the mailer.

In yet other embodiments of the mailer packaging apparatus, the mailer closing station comprises an internal folding member positioned on an internal surface of a mailer, an external folding member positioned on a first outer surface of the mailer, and a closing actuator operatively coupled to the external folding member. The external folding member is configured to engage the first outer surface of the mailer to fold a lip of the mailer around the internal folding member for operatively coupling the lip to a second outer surface of the mailer.

In still other embodiments, the mailer packaging apparatus further comprises a mailer discharge station that is configured to remove a packaged mailer from a mailer packaging station.

In further accord with embodiments of the mailer packaging apparatus, the mailer discharge station comprises a mailer pusher, and a mailer pusher actuator operatively coupled to the mailer pusher. The mailer pusher actuator is configured to discharge the packaged mailer from the mailer packaging station.

In other embodiments, the mailer packaging apparatus further comprises a controller operatively coupled to the handling station and the mailer supply station. The controller is configured to operate the handling station and the mailer supply station. The controller receives an indication of a product from a product delivery system being received in the mailer packaging apparatus. The controller determines a mailer for the product being received from the plurality of magazines holding the mailers. In response to identifying the mailer, the controller activates the mailer supply station to pick the mailer for the product.

Another embodiment is a method of packaging a product in a mailer using a mailer packaging apparatus. The mailer packaging apparatus comprises a handling station having a robot operatively coupled to a mailer supply station having a plurality of magazines for holding mailers. The method comprises moving a first magazine of the plurality of magazines adjacent to the robot and a second magazine away from the robot. The first magazine is configured to hold a plurality of first mailers and the second magazine is configured to hold a plurality of second mailers, and the plurality of magazines are movable with respect to the robot. The method further comprises moving the robot to pick the mailer from the first magazine adjacent to the robot.

To the accomplishment the foregoing and the related ends, the one or more embodiments comprise the features hereinafter described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

The following figures (sometimes abbreviated as "Fig." or "Figs." herein) will now be described by way of example, not by way of limitation, in which.

Figure 1:
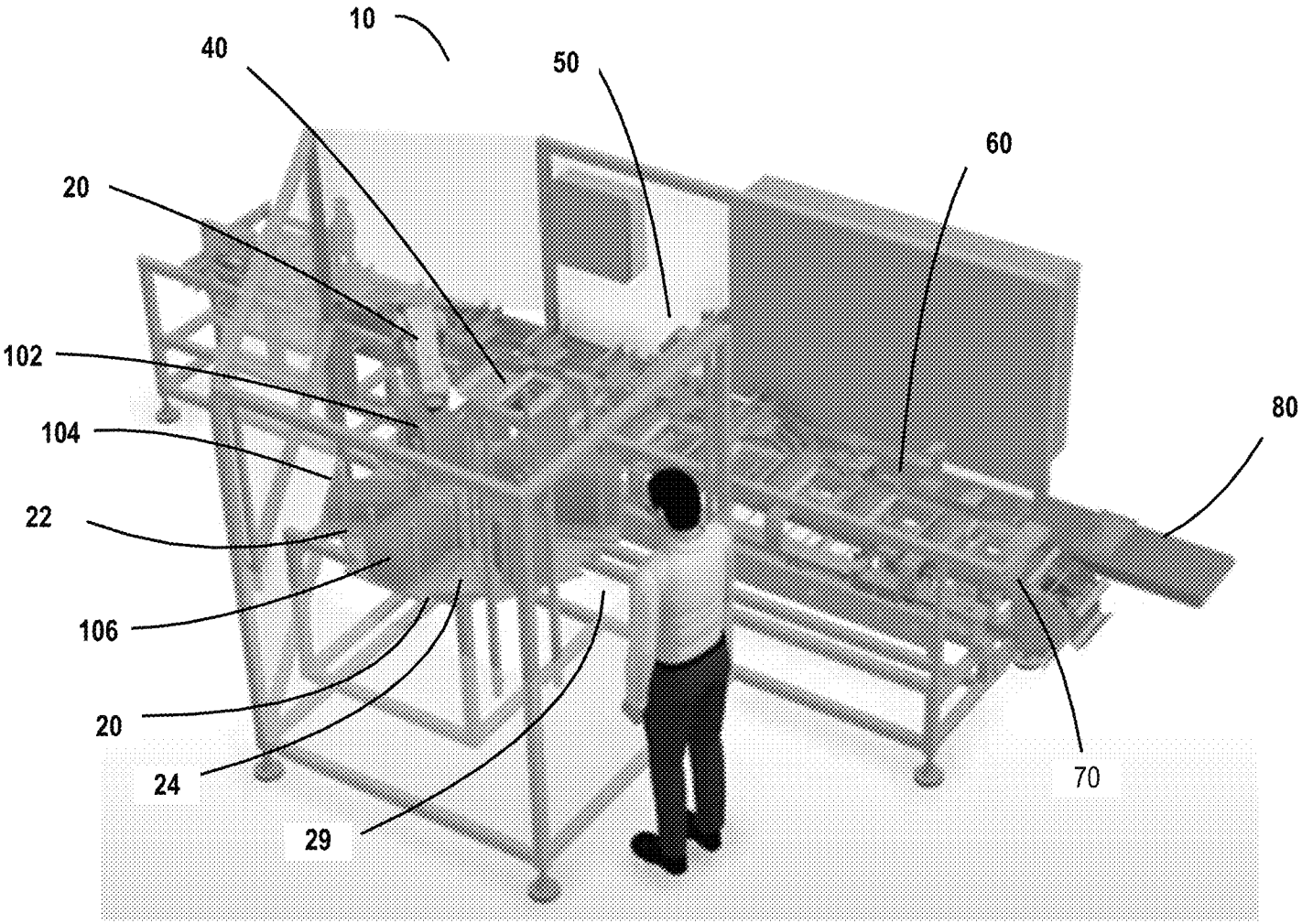
FIG. 1 is a perspective view of a mailer machine, in accordance with embodiments of the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible to embodiments in many different forms, there is shown in the drawings, and will herein be described in detail, embodiments of the present disclosure with the understanding that the present disclosure is to be considered as an exemplification of the principles of the present disclosure and is not intended to limit the broad aspect of the present disclosure to the embodiments illustrated.

A mailer machine 10 (otherwise described herein as a mailer apparatus 10, mailer packaging apparatus 10, mailer system 10, mailer packaging system 10, or the like) in accordance with the present disclosure is shown in FIG. 1. The mailer machine 10 includes a mailer supply station 20 (e.g., a rotary mailer supply station as illustrated, a linear mailer supply station, a non-linear mailer supply station, or the like) and a handling station 30 operatively coupled to the mailer supply station 30. The mailer supply station 20 provides, on a selective basis, mailers 100 (e.g., in some applications, mailer blanks, pre-formed mailers, or the like). It should be understood that a "mailer" is a package that has outer surfaces and at least one open end, in which a product can be inserted, the mailer can be closed (e.g., a mailer lip 110 may be folded and operatively coupled to an outer surface, lips may be sealed together, a portion of the ends may be sealed together, or the like to enclose the product in the mailer). In some embodiments the mailer 100 may be a pre-formed mailer that may have two outer surfaces 112, 113, two closed edges 114, 115, one closed end 116, and one open end 117. Alternatively, the mailer 100 may be at least partially required to be folded into a shape within the mailer machine 10. The mailers 100 may be any type of mailer, such as, booklet, catalog, side open, square gusseted, and/or other like mailer. Moreover, the mailers 100 may be made of any material such as paper, plastic, cardboard, or other like materials. In particular embodiments the mailers 100 may be made of paper that can be easily recycled.

As will be described herein in further detail, the handling station 30 picks the mailer 100 from the mailer supply station 20, places the mailer 100 in the packaging station 40, which in some embodiments may include a plurality of mailer pockets 46, as will be described in further detail herein. The packaging station 40 may open the mailer 100 (e.g., mailer pocket 46 adjusts to squeeze the edges of the mailer 100, or the like) and moves the mailer into positions within the mailer machine 10 for further processing, such as adjacent a product supply station 50. Alternatively, or additionally, the product supply station 50 may open the mailer 100, as will be described in further detail herein. The product supply station 50 may pack the mailer 100 with a product. The packaging station 40 may then move the mailer 100 from the product supply station 50 to a mailer closing station 60. The mailer closing station 60 closes the mailer (e.g., folds a lip to close the opening of the mailer 100, or the like). The packaging station 40 may also move the mailer 100 from the closing station to a mailer discharge station 70. The mailer discharge station 70 may transfer the mailer 100 from the packaging station 40 to a transport station 80. Alternatively, in some embodiments, the packaging station 40 may discharge the mailer 100 from the packaging station 40 to the transport station 80 directly. The transport station 80 may transport the mailer 100 for further processing, as will be described in further detail herein.

The operation of the mailer machine 10, including the mailer supply station 20, the handling station 30, the packaging station 40, the product supply station 50, the mailer closing station 60, the mailer discharge station 70, transport station 80, or the like (e.g., a printing station, labeling station, or the like), sensors within the mailer machine 10, as well as the communication between and/or operation of different systems upstream and/or downstream of the mailer machine 10 may be controlled by a programmable controller 90, as will be described in further detail herein. A graphical user interface (GUI) 92 may be operatively coupled with the controller 90, and the controller 90 and GUI 92 may be used to permit an operator to set operating parameters, operate, monitor, adjust and/or the like the mailer machine 10 and/or the products being delivered to the mailer machine 10 and mailers 100 used within the mailer machine 10, as will be discussed in further detail herein.

The mailer supply station 20 may include a plurality of magazines 22 (e.g., two or more magazines) and the mailer handling station 30 may include a robot 32. The plurality of magazines 22 are allowed to move with respect to the robot 32 of the handling station 30. In some embodiments the robot 32 has at least one portion that is mounted in fixed location (e.g., a distal end of the robot 32 is fixed to a support member, such as a base 34 while a proximal end is moveable to allow the robot 32 to pick the mailers 100). However, it should be understood that in some embodiments the location of the robot 32 and the magazines 22 may both be moveable with respect to each other to allow for more flexibility of the mailer machine 10. In some embodiments, the magazines 22 are mounted on a support member (e.g., a moveable base, such as a rotatable base 24—otherwise described as a turntable —, or other like member), which allows for positioning of the magazines 22 relative to the handling station 30 and/or one or more loading stations 29. For example, a motor (not shown) is operably coupled to the base 24 to move the base 24 during operation of the mailer machine 10 (e.g., rotatable base to angularly displace the base 24 during operation of the mailer machine 10). Alternatively, the magazines 22 may be moved along a conveyer, by independent machines (e.g., drivable wheel(s) on each magazine 22, or the like), through the use of a track, or the other like devices in other embodiments of the disclosure.

As shown in FIG. 1, the mailer supply station 20 may include six (6) magazines 22 arranged along a periphery of the rotatable base 24. However, it should be understood that any number of magazines 22 may be utilized (e.g., 2, 3, 4, 5, 6, 7, 8, 9, 10, 12, 14, 16, 18, 20, or more magazines, or any number of magazines that range between, overlap, or fall outside of these values). The magazines 22 may be arranged to receive two or more stacks of mailers 100 having dissimilar attributes (e.g., dissimilar mailer sizes, openings, opening locations, expandability, material, cushioning, or the like) for handling by the mailer machine 10. For example, stacks of mailers 102, 104, 106, or the like can be installed in the magazines 22, wherein each stack of mailers 100 can have similar or different attributes. For example, the mailers 102 in a first magazine 22 can be of the same configuration as the mailers 104, 106 in a second and a third magazine 22, or other magazines. In other examples, the mailers 102 in the first magazine 22 can be of a different configuration than the mailers 104, 106 in the second and the third magazines 22, or other magazines, for increased variety and to allow short runs of several differently configured mailers 100 to be erected in succession or intermittently through the mailer machine 10. In this way, each magazine 22 may be removeable (e.g., removable from the base 24) or each magazine 22 may be adjustable in order to hold different mailers 100 having different attributes (e.g., different sizes, configurations, or the like). In this manner, the mailer machine 10 can efficiently handle and process a first set of mailers 102, a second dissimilar set of mailers 104, a third dissimilar set of mailers 106, or $n^{th}$ dissimilar set of mailers 100, without needing an operator to manually change-out the mailers 100 in a stationary magazine 22 and/or change-out the magazines 22 themselves. As such, the mailers 100 with different attributes can be handled and processed by the mailer machine 10 as mailers 100 with the different attributes are requested for different products or for different amounts of the same product. With respect to being dissimilar, the mailers 100 (e.g., first mailers 102, second mailers 104, third mailers 106, $n^{th}$ mailers, or the like) can have different attributes, such as sizes, configurations (e.g., peripheries, fold locations, opening locations, or the like), color layouts, labeling, text, graphics, or the like, or a combination of these different attributes.

The handling station 30 includes a robot 32 and a mailer feeding mechanism (e.g., an elevator mechanism 34, or other like feeding mechanism). The mailer supply station 20 operates to position the magazines 22 (e.g., a single magazine 22 at a time or multiple magazines 22 at a time from the plurality of magazines 22) adjacent to the robot 32 for picking the mailer 100 from the magazines 22 (e.g., a single magazine 22 or multiple magazines 22). As previously discussed herein, in some embodiments, the robot 32 may also be able to move locations (e.g., the distal end may be able to be moved), or the robot 32 may be able to reach two or more magazines 22 from the plurality of magazines 22 located adjacent the robot 32 (e.g., in a magazine picking location). However, in particular embodiments, the robot 32 has a distal end that is fixed (e.g., stationary) and can only pick mailers 100 from a single magazine 22 at a time. In some examples, the magazine 22 containing the mailers 100 is moved by the base 24 to be adjacent to the robot 32 in a magazine picking location, as shown in FIG. 2.

When a magazine 22 is located in the picking location, the mailer feeding mechanism may be utilized in order to position one or more of the mailers 100 (e.g., a stack of mailers 100, or the like) in a mailer pick-up position at which the robot 32 can pick the mailer 100. For example, the mailer feeding mechanism may comprise an elevator mechanism 34 that engages with the magazine 22 to move the stack of mailers 100 in the magazine 22 to a pre-determined mailer pick-up position for access by the robot 32. For example, the stack of mailers 100 may be elevated within the magazine 22 such that the top exposed mailer 100 is moved to the pre-determined mailer pick-up position such that the robot 32 repeatably picks the mailers 100 from the same pre-determined mailer pick-up position.

While the mailer supply station 20 and the handling station 30 have been described generally, the individual components of the foregoing may be described in further detail below. For example, as shown in FIGS. 2-4, each magazine 22 may comprise a support member 26 (e.g., a support plate) and guide rails 28 extending from the support member 26. The mailers 100 are stacked onto the support member 26 and the guide rails 26 maintain a relative orientation of the mailers 100 within the magazine 22. In some embodiments, the guide rails 28 are adjustable to adapt for mailers 100 having different attributes (e.g., different sizes, shapes, or the like). For example, the guide rails 28 are positionable with respect to the support member 26 in different locations of the support member 26 (e.g., slidable, repositionable in different holes in the support member 26, or the like). The elevator mechanism 34 of the handling station 30 raises and lowers the support member 26 and/or the mailer at the bottom of the stack of mailers.

Figure 2:
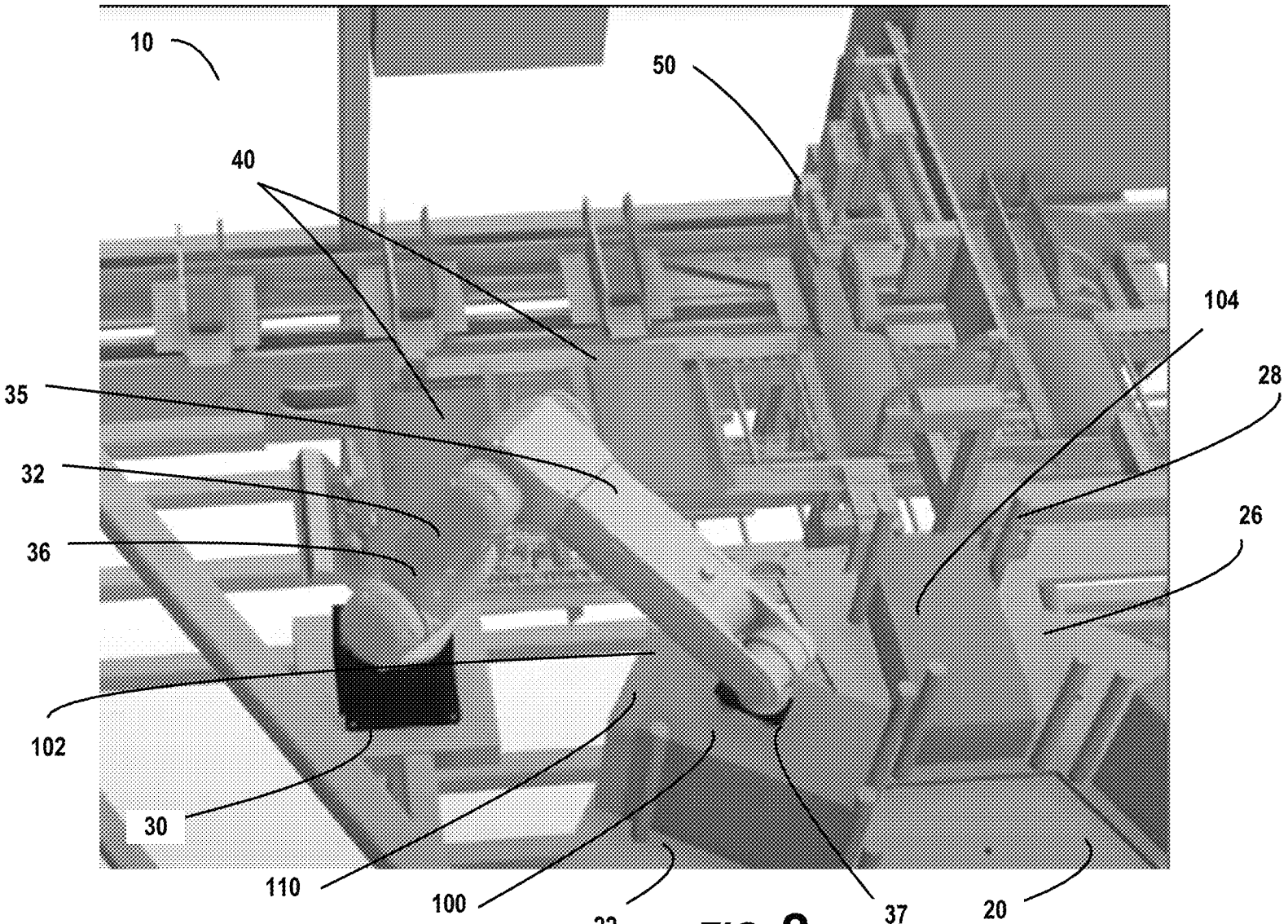
FIG. 2 is a perspective view of a portion of a handling station of the mailer machine picking a mailer, in accordance with embodiments of the present disclosure.
Figure 3:
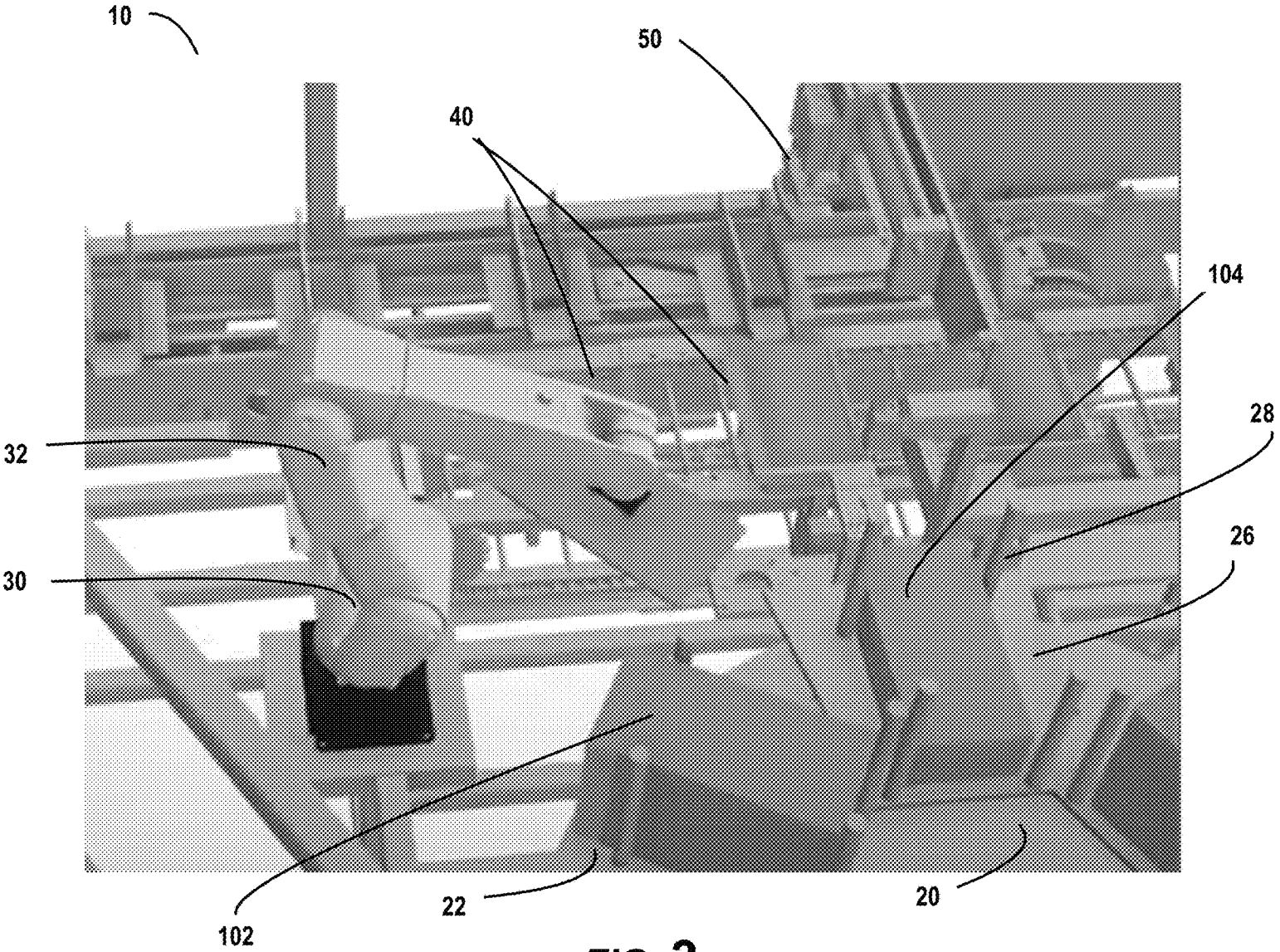
FIG. 3 is a perspective view of a portion of a handling station of the mailer machine moving the mailer to a packaging station, in accordance with embodiments of the present disclosure.
Figure 4:
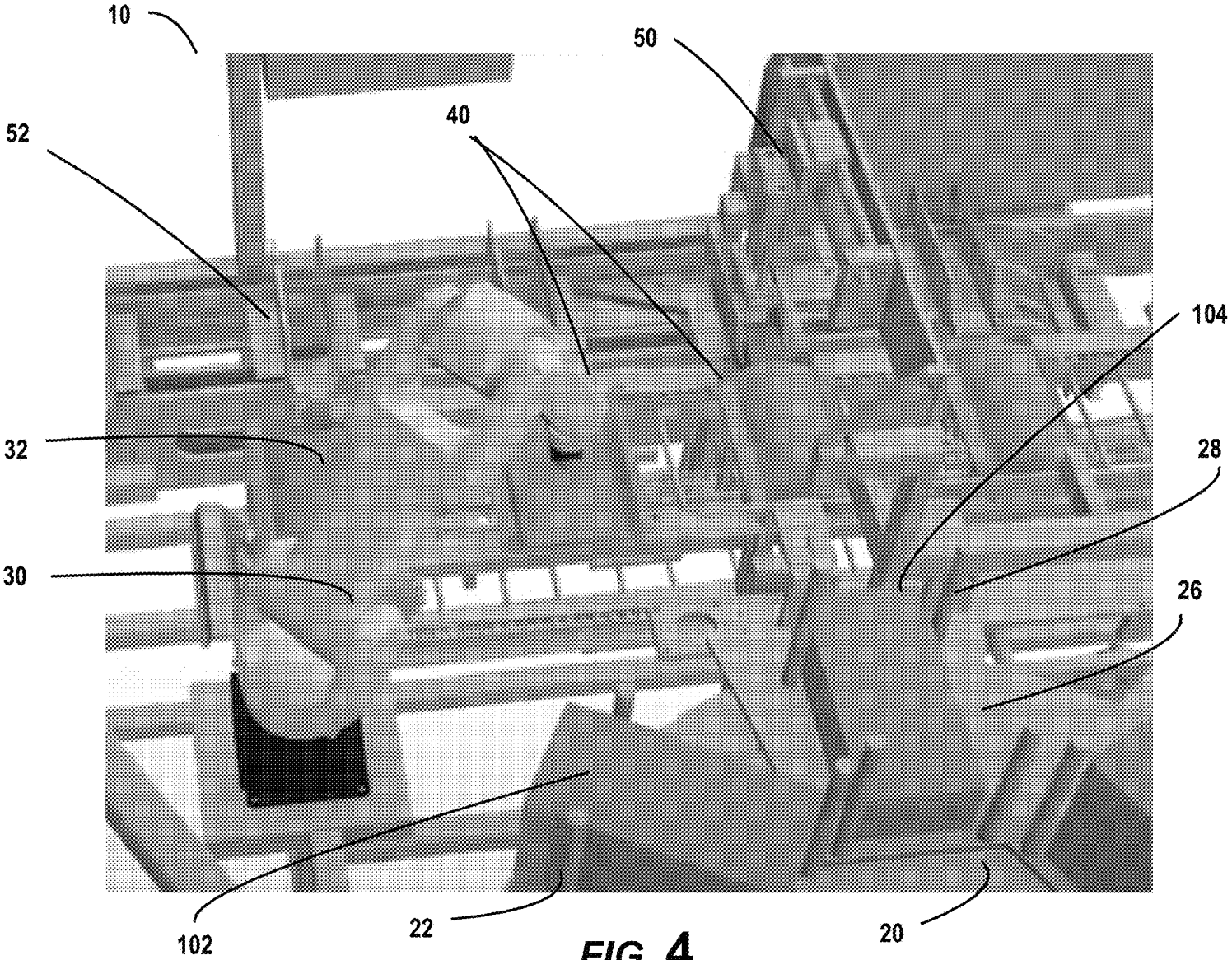
FIG. 4 is a perspective view of a portion of a handling station of the mailer machine depositing the mailer at the packaging station, in accordance with embodiments of the present disclosure.

As illustrated in FIGS. 2-4, the robot 32 of the handling station 30 may include one or more moveable arms. In some embodiments a first arm 35 is operatively coupled to a second arm 36 as shown in FIGS. 2-4. In other embodiments, a robot 32 having more arms may be utilized. A gripping hand 37 may be operatively coupled to the first arm 35 for movement with the first arm 35 relative to the second arm 36. In the illustrative embodiment, the gripping hand 37 includes one or more suction components 38 (e.g., a plurality of suction devices, or the like) for gripping the mailer 100. For example, the one or more suction components 38 may utilize air suction to pick a mailer 100 from the magazine 10. In other embodiments other types of devices may be used to pick the mailers 100, such as robotic fingers that grip an end or are inserted into a portion of the mailer 100, or other like gripping components.

As illustrated in FIGS. 3 and 4, after the robot 32 picks the mailers 100 from the magazine 22, the robot 32 moves the mailers to the packaging station 40. It should be understood that many different types of packaging stations 40 may be used. However, as illustrated in the figures, the packaging station 40 may comprise one or more mailer packing systems 42 (e.g., a plurality of mailer packing systems 42, or the like). The one or more mailer packing systems 42 may comprise one or more mailer pockets 46 (e.g., a plurality of mailer pockets 46, or the like), that are configured to extend and retract in order to secure mailers 100 having different attributes and/or to expand the mailers (e.g., expand an open end, expand other portions of the mailer, or the like). The one or more mailer packing systems 42 (e.g., one or more mailer pockets 46) may be operatively coupled to a mailer transfer system 48 (e.g., one or more of conveyor(s), roller (s), track(s), gear(s), chain(s), belt(s), or the like) that moves the one or more mailer pockets 46 between different stations within the mailer machine 10. As such, the mailer transfer system 48 may move the one or more packing systems 42 throughout at least a portion of the machine 10, such as to the different stations within the machine 10, as will be discussed in further detail herein.

Figure 5A:
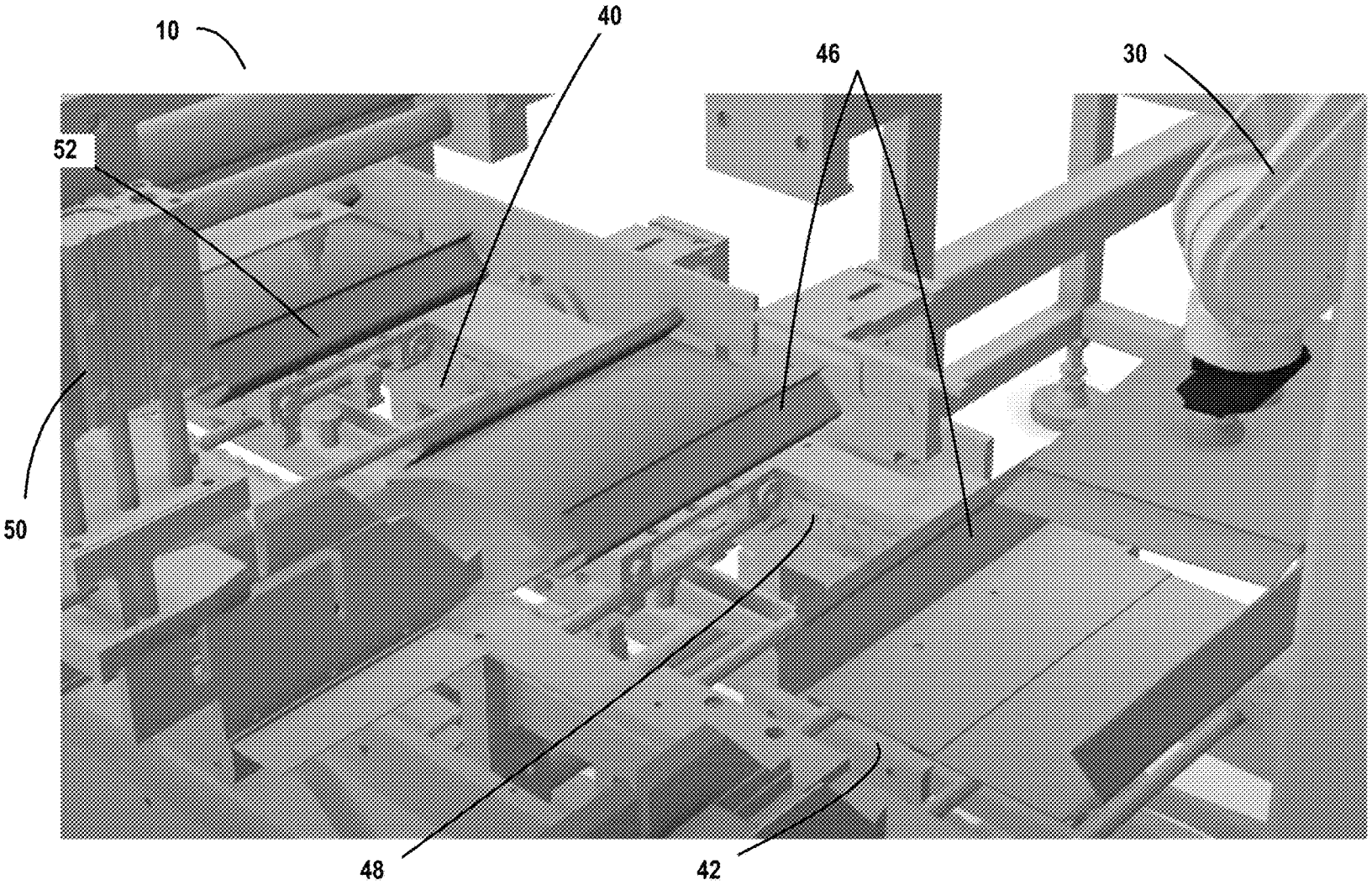
FIG. 5A is a perspective view of a portion of the packaging station of the mailer machine before the mailer is deposited in one portion and with the mailer deposited and opened in another portion, in accordance with embodiments of the present disclosure.
Figure 5B:
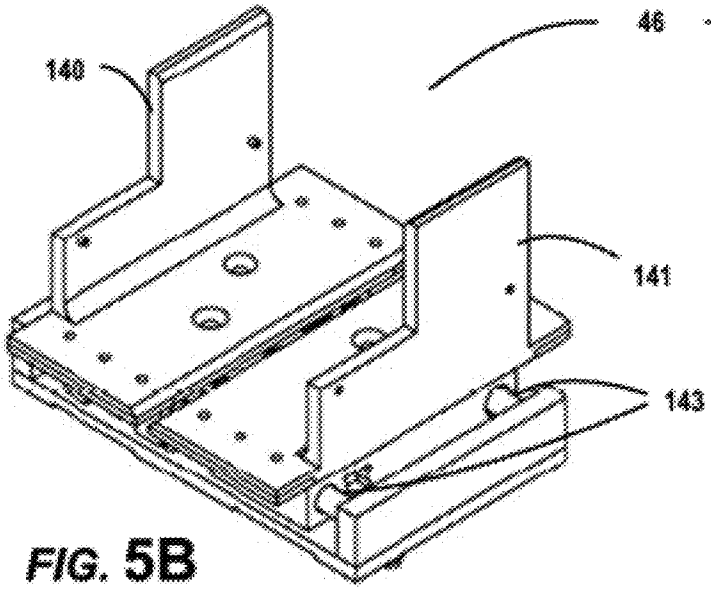
FIG. 5B is perspective view of a mailer pocket of the packaging station of the mailer machine for opening the mailer, in accordance with embodiments of the present disclosure.
Figure 5C:
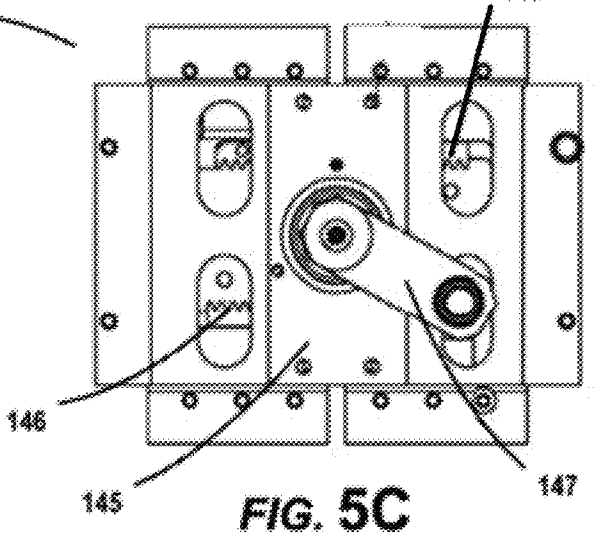
FIG. 5C is a bottom view of a mailer pocket of the packaging station of the mailer machine for opening the mailer, in accordance with embodiments of the present disclosure.
Figure 5E:
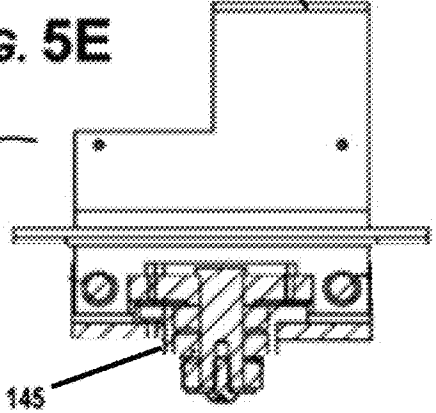
FIG. 5E is a cross-sectional view of the mailer pocket of the packaging station of FIG. 5D of the mailer machine for opening the mailer, in accordance with embodiments of the present disclosure.
Figure 5D:
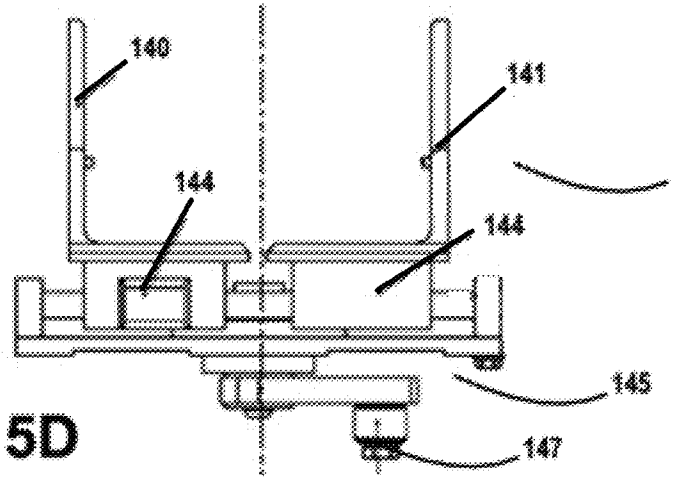
FIG. 5D is a front view of a mailer pocket of the packaging station of the mailer machine for opening the mailer, in accordance with embodiments of the present disclosure.
Figure 5G:
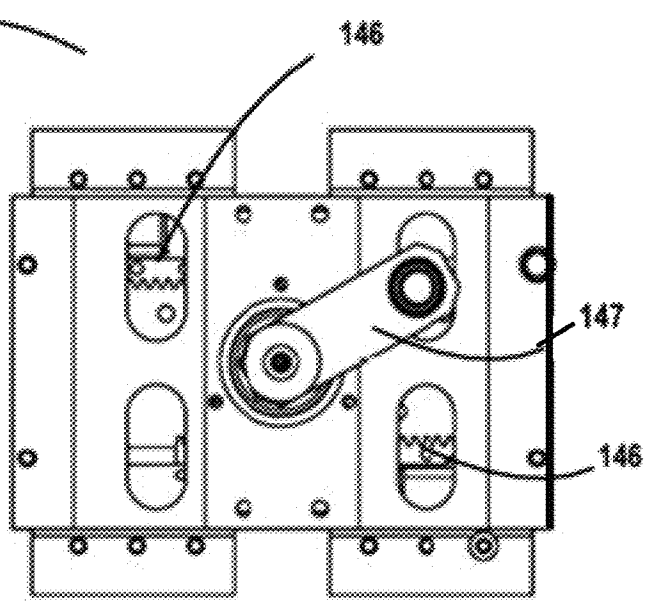
FIG. 5G is a bottom view of the mailer pocket of the packaging station in an extended position, in accordance with embodiments of the present disclosure.
Figure 5F:
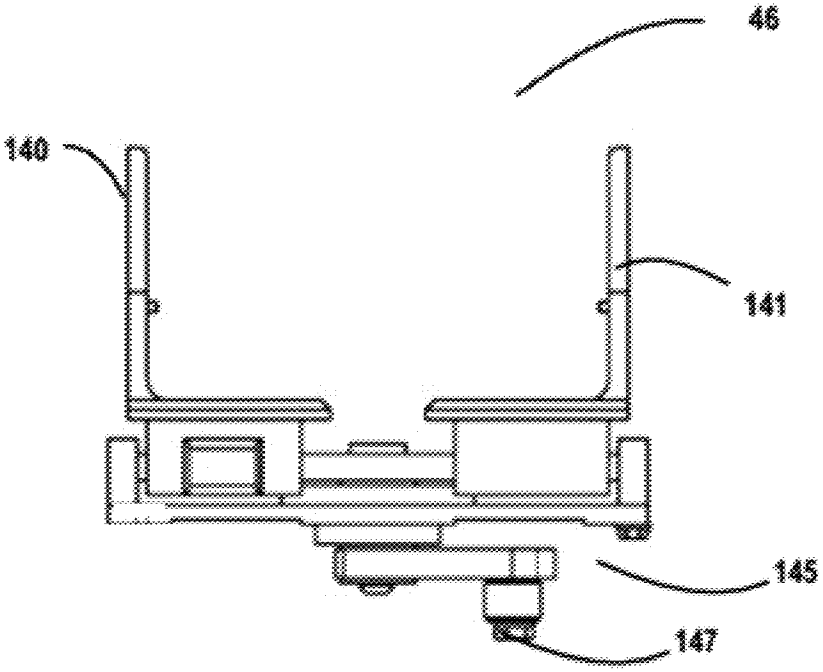
FIG. 5F is a front view of the mailer pocket of the packaging station in an extended position, in accordance with embodiments of the present disclosure.

FIGS. 5A-5J illustrate different embodiments of the one or more mailer pockets 46. FIGS. 5B-5G illustrates a mailer pocket 46 in accordance with some embodiments of the invention. For example, the one or more mailer pockets 46 may comprise a first portion 140 (e.g., first L-shaped portion, v-shaped portion, or the like) and a second portion 141 (e.g., second L-shaped portion, v-shaped portion, or the like) that are operatively coupled to each other. For example, the first pocket portion 140 may be adjustable with respect to the second pocket portion 141 through the use of a pocket adjustment system 142. The pocket adjustment system 142 may include any type of device that moves the first pocket portion 140 and/or the second pocket portion 141 of the one or more mailer pockets 46. In some embodiments, the pocket adjustment system 142 comprises one or more tracks 143 (e.g., shafts, or the like), one or more slides 144 (e.g., mounting block slides, or the like), a pocket actuator system 145, such as one or more drive members 146 (e.g., rack and pinion, gears, cams, arms, or the like) and/or one or more drives 147 (e.g., motor, pneumatic actuator, hydraulic actuator, mechanical—lever that is moved as the pocket 46 moves between stations —, or other like component) that drives the movement of the first pocket portion 140 and/or the second pocket portion 141, such as along the one or more tracks 143 using the one or more slides 144. For example, FIGS. 5B-5D illustrates a pocket 46 in a retracted position, while FIGS. 5F and 5G illustrates the pocket 46 in an extended position.

Figure 5I:
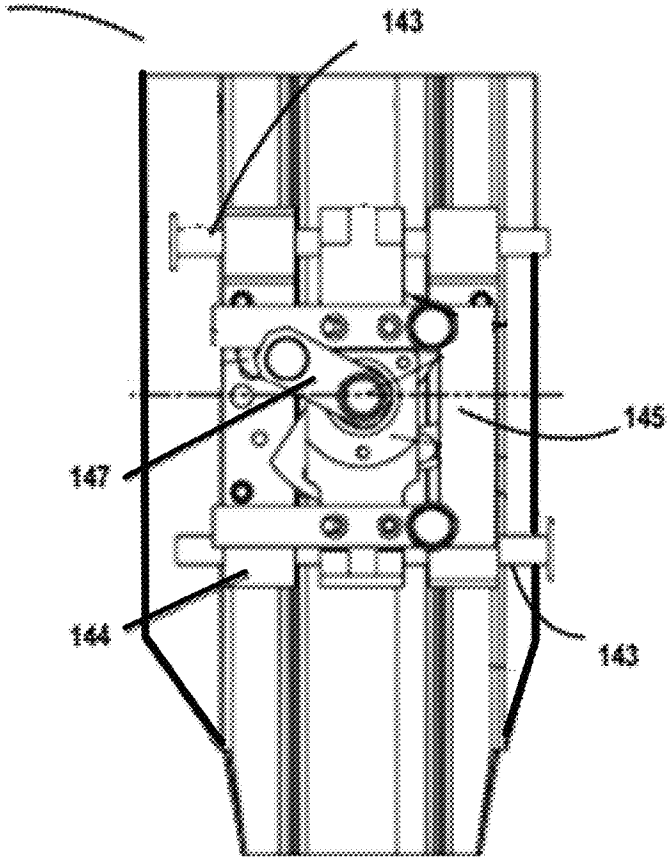
FIG. 5I is a bottom view of a mailer pocket of the packaging station of the mailer machine for opening the mailer, in accordance with embodiments of the present disclosure.
Figure 5H:
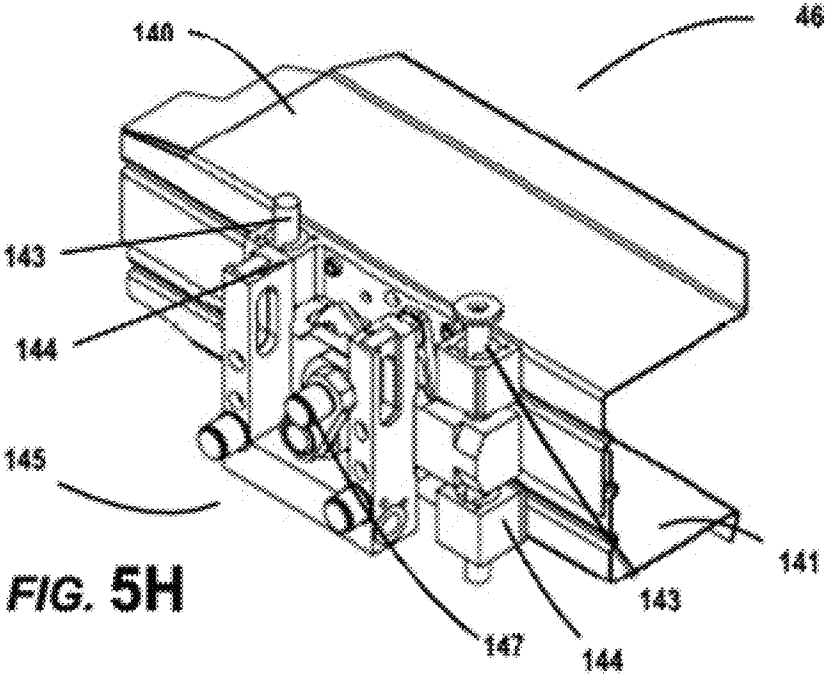
FIG. 5H is perspective view of a mailer pocket of the packaging station of the mailer machine for opening the mailer, in accordance with embodiments of the present disclosure.
Figure 5J:
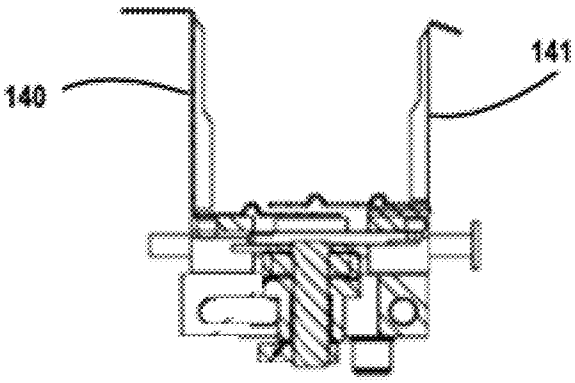
FIG. 5J is a front view of a mailer pocket of the packaging station of the mailer machine for opening the mailer, in accordance with embodiments of the present disclosure.

FIGS. 5H-5J illustrates alternate embodiments of the one or more mailer pockets 46. As illustrated in FIG. 5H-5J, the one or more mailer pockets 46 may have the same or similar components as previously discussed with respect to FIGS. 5B-5G. However, in the embodiments illustrated in FIGS. 5H-5J, the first pocket portion 140 and the second pocket portion 141 and/or the one or more tracks 143, one or more slides 144, a pocket actuator system 145 (e.g., one or more drive members 146 and/or one or more drives 147) may have different configurations.

In alternate embodiments of the invention, instead of a first pocket portion 140 moving with respect to a second pocket portion 141, the first pocket portion 140 and the second pocket portion 141 may simply flex with respect to each other in order to secure and/or open the mailer 100. However, in some embodiments having a first pocket portion 140 move with respect to a second pocket portion 141 may provide for the ability to use mailers 100 having a larger range of sizes (e.g., when compared to a pocket that only flexes).

Regardless of the configuration of the mailer pockets 46, each mailer pocket 46 may expand to one or more expansion positions in order to receive different types of mailers 100 having different attributes, and thereafter retract to one or more retraction positions for securing different mailers (e.g., so mailers are retained in the pocket 46) and/or for opening the mailer 100 as a first pocket portion 140 and a second pocket portion 141 squeeze the edges of the mailer 100 for opening the mailer 100.

It should be understood that the mailer pockets 46, and the components illustrated herein, are example embodiments of the mailer pockets 46 and other components and/or configurations thereof may be utilized to hold (e.g., based on different mailer attributes), open (e.g., for receiving a product), and shut (e.g., retract from the open position) before the mailer 100 is closed in the closing station 60

Instead of the pocket squeezing the mailer 100 in order to open the mailer 100, in other embodiments of the invention the mailer 100 may be opened using other components, such as but not limited to: one or more fingers that are inserted into the mailer 100 and which expand to open the mailer 100; one or more suction features that are used to space a first outer surface and a second outer surface away from each other; a tab or portion of the mailer may be automatically pulled; a product supply component that is used to both open the mailer 100 and provide product to the mailer 100; and/or other like configurations.

Figure 6:
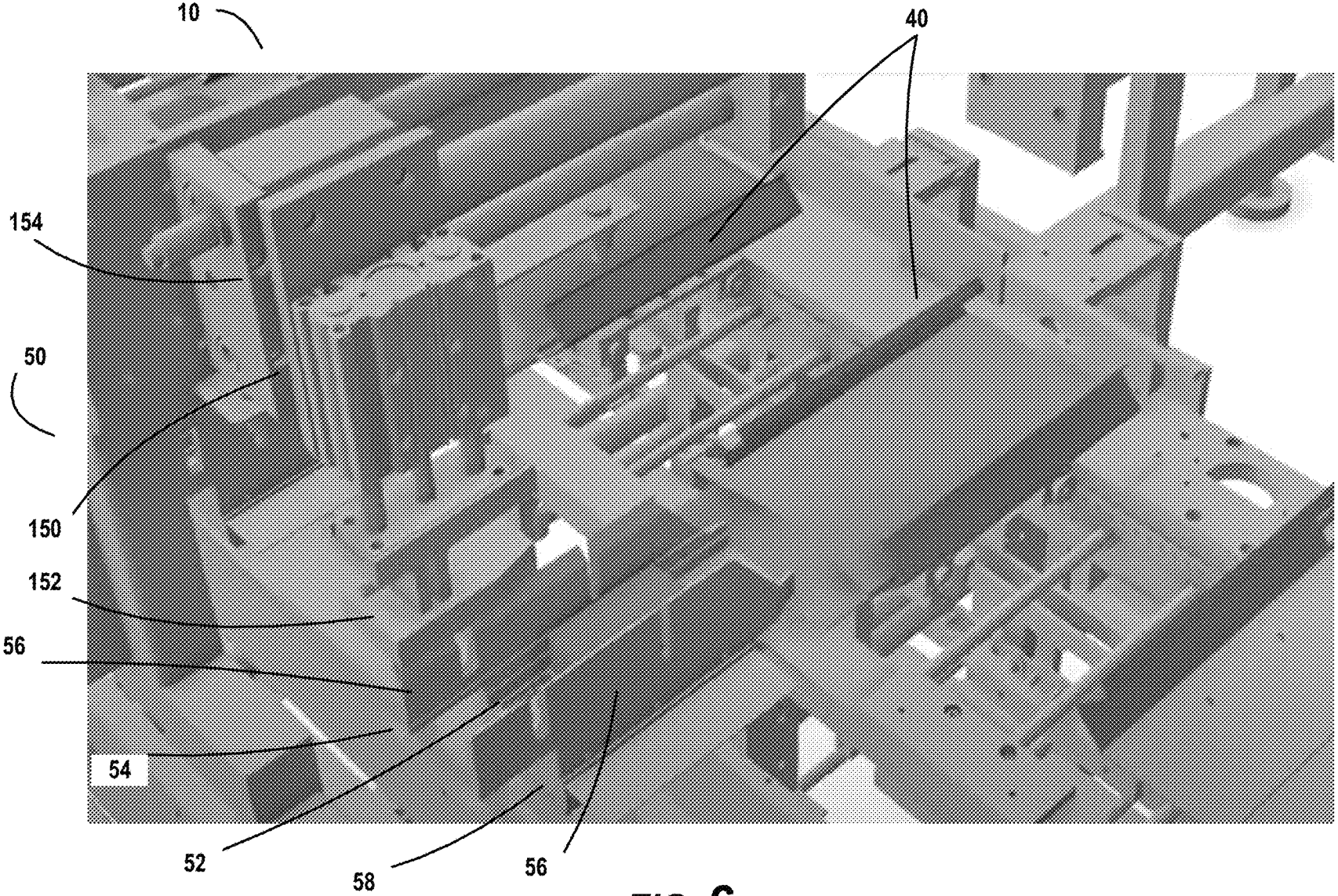
FIG. 6 is a perspective view of a portion of the product supply station of the mailer machine after the mailer is opened and positioned to receive a product, in accordance with embodiments of the present disclosure.
Figure 7:
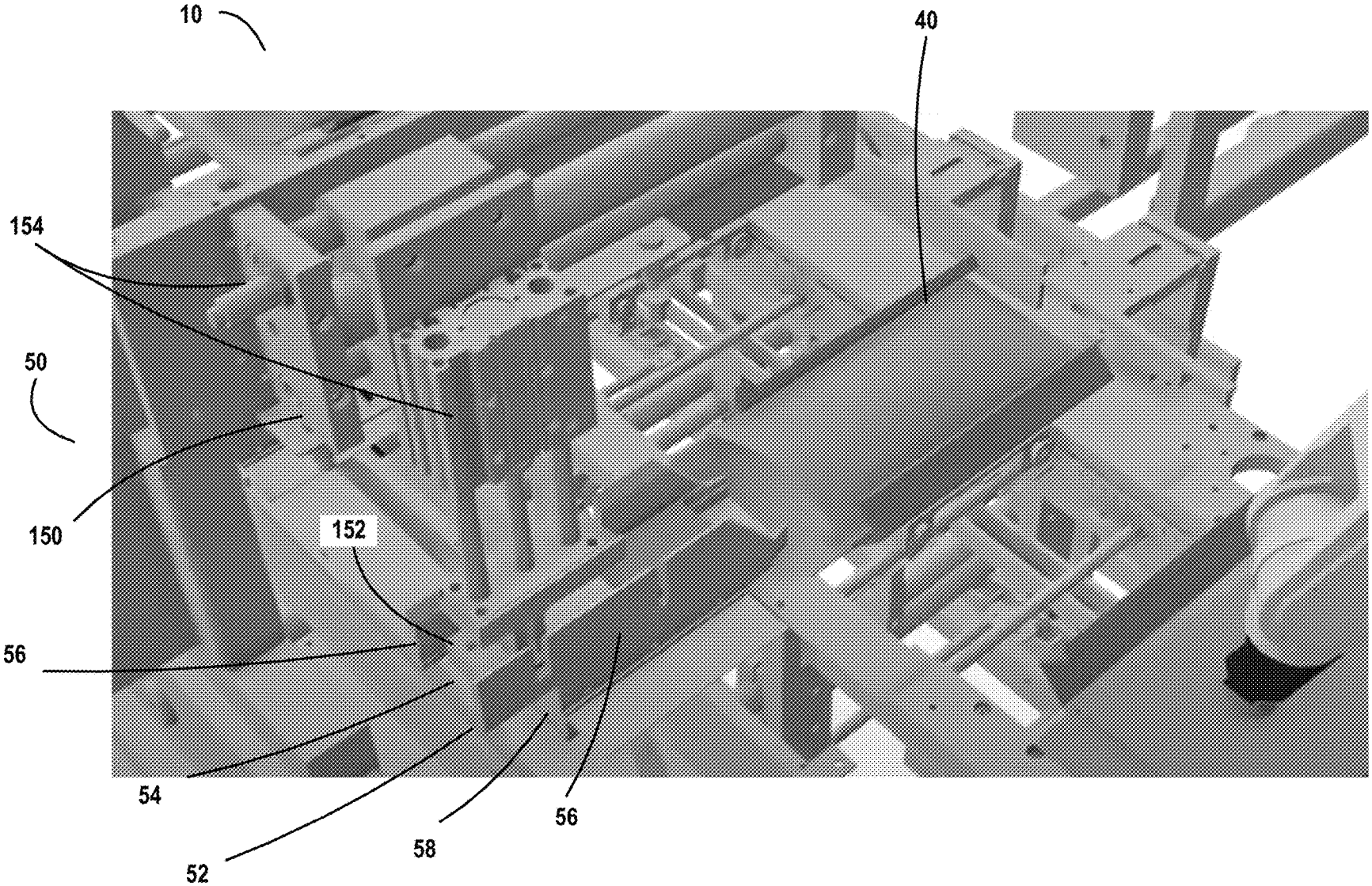
FIG. 7 is a perspective view of a portion of the product supply station of the mailer machine with the product pusher moved into place for packaging a product, in accordance with embodiments of the present disclosure.
Figure 8:
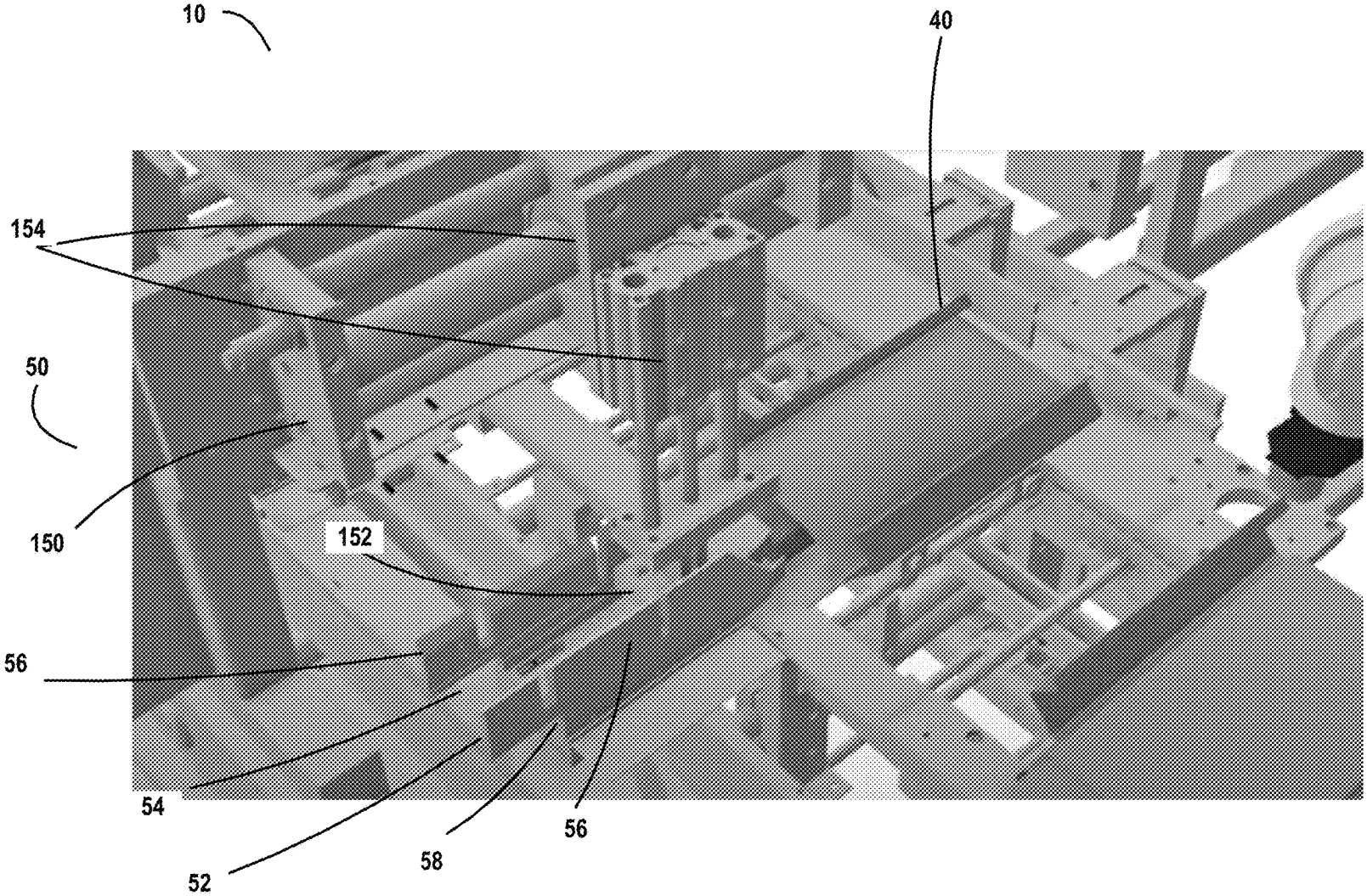
FIG. 8 is a perspective view of a portion of the product supply station of the mailer machine with the product pusher moving the product into the mailer, in accordance with embodiments of the present disclosure.
Figure 9:
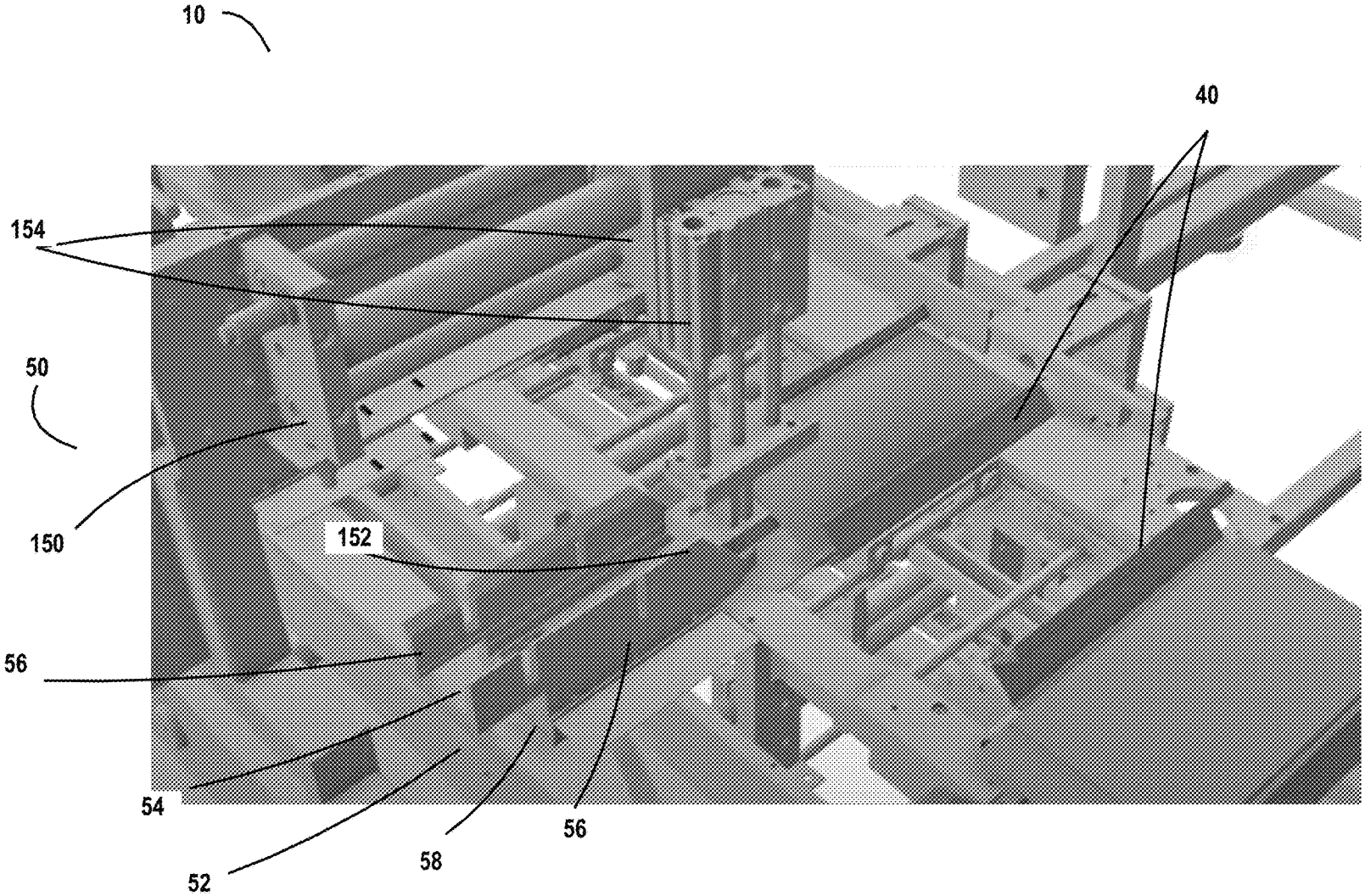
FIG. 9 is a perspective view of a portion of the product supply station of the mailer machine with a portion of the product pusher and the product in the mailer, in accordance with embodiments of the present disclosure.
Figure 10:
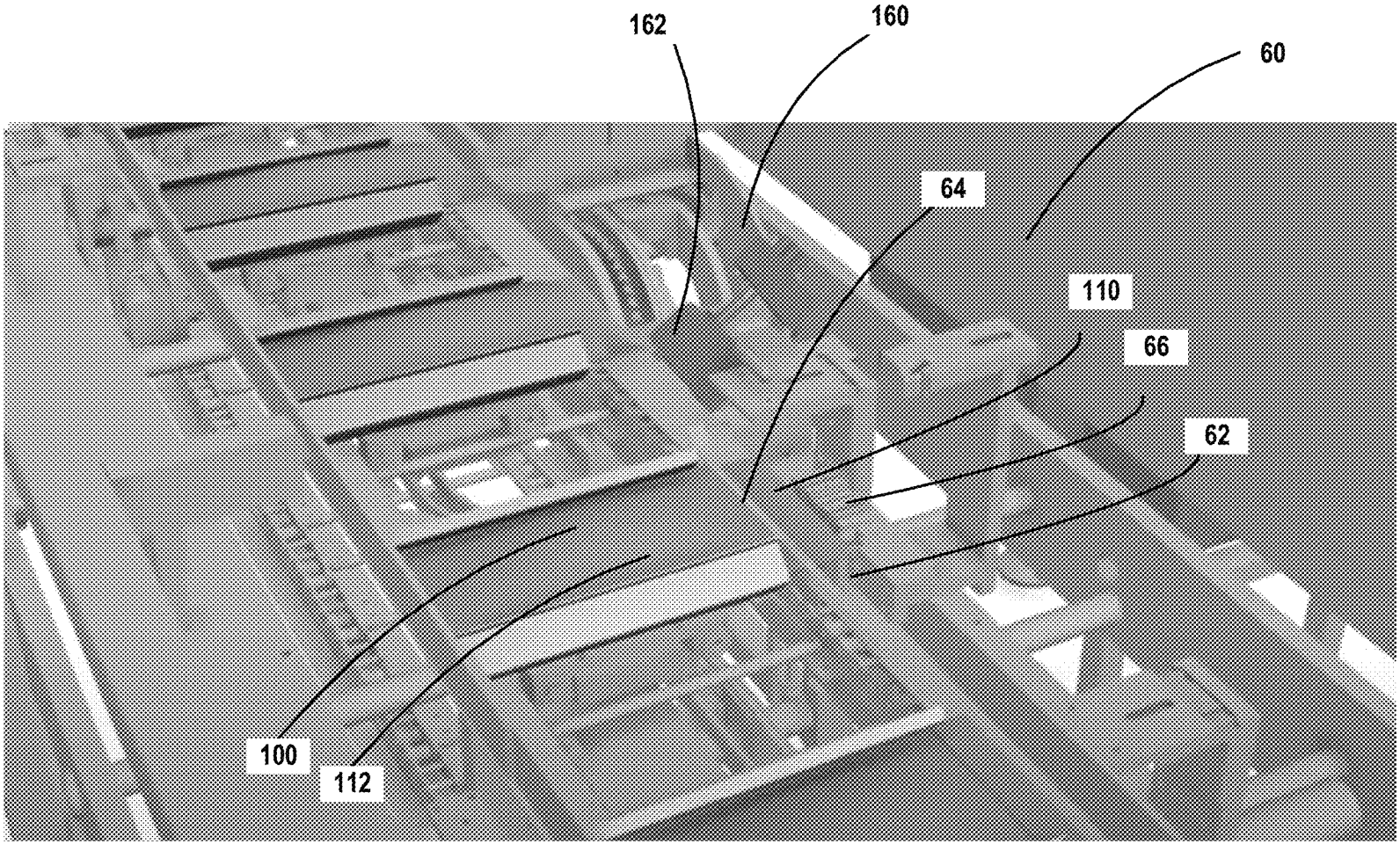
FIG. 10 is a perspective view of a mailer closing station of the mailer machine with a mailer located in position for closing, in accordance with embodiments of the present disclosure.
Figure 11:
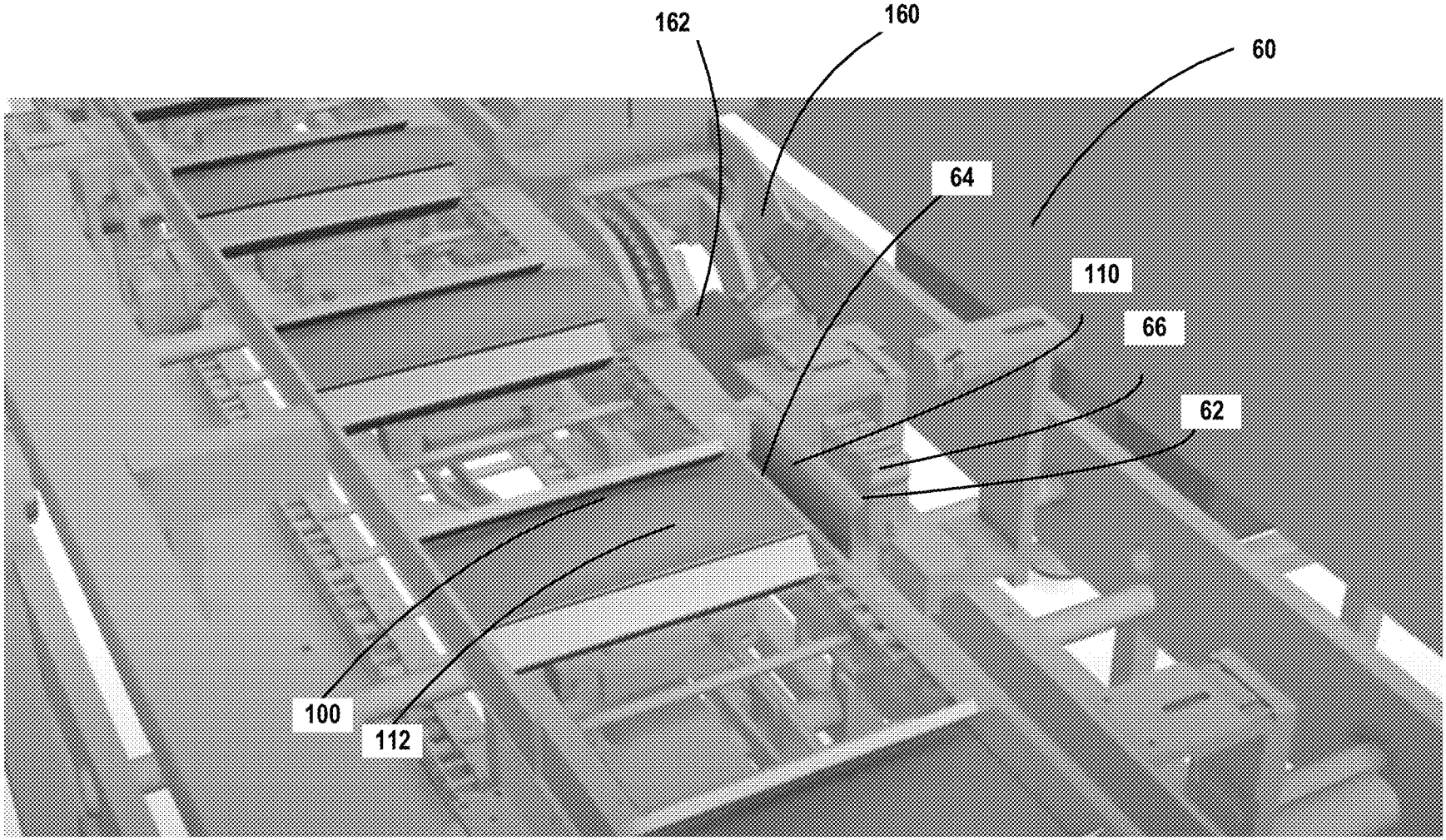
FIG. 11 is a perspective view of a mailer closing station of the mailer machine with a lip of the mailer being folded for closing, in accordance with embodiments of the present disclosure.
Figure 12:
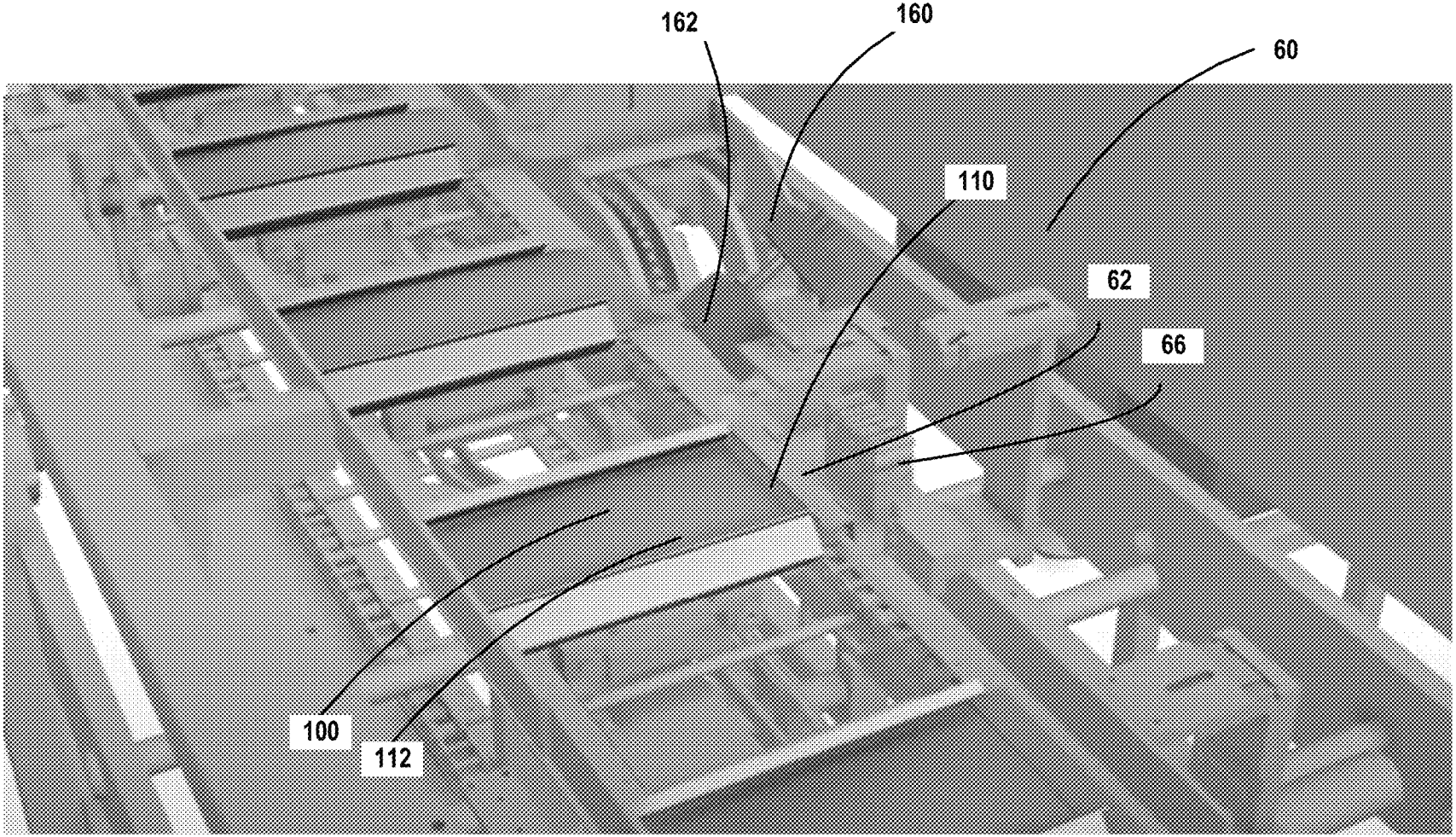
FIG. 12 is a perspective view of a closing station of the mailer machine with a lip of the mailer folded to close the mailer, in accordance with embodiments of the present disclosure.
Figure 13:
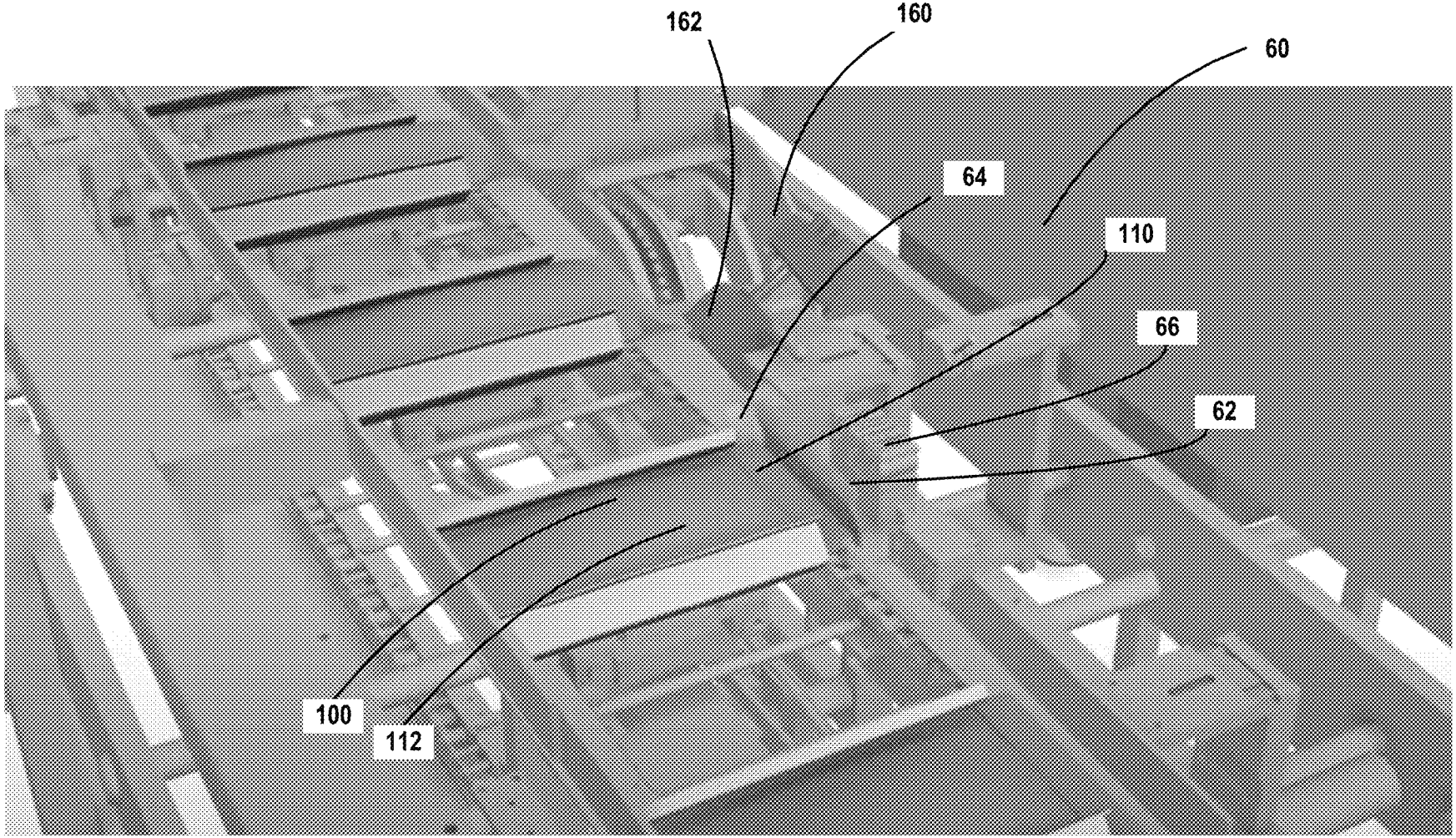
FIG. 13 is a perspective view of a mailer closing station of the mailer machine with a closing member being retracted after closing, in accordance with embodiments of the present disclosure.
Figure 14:
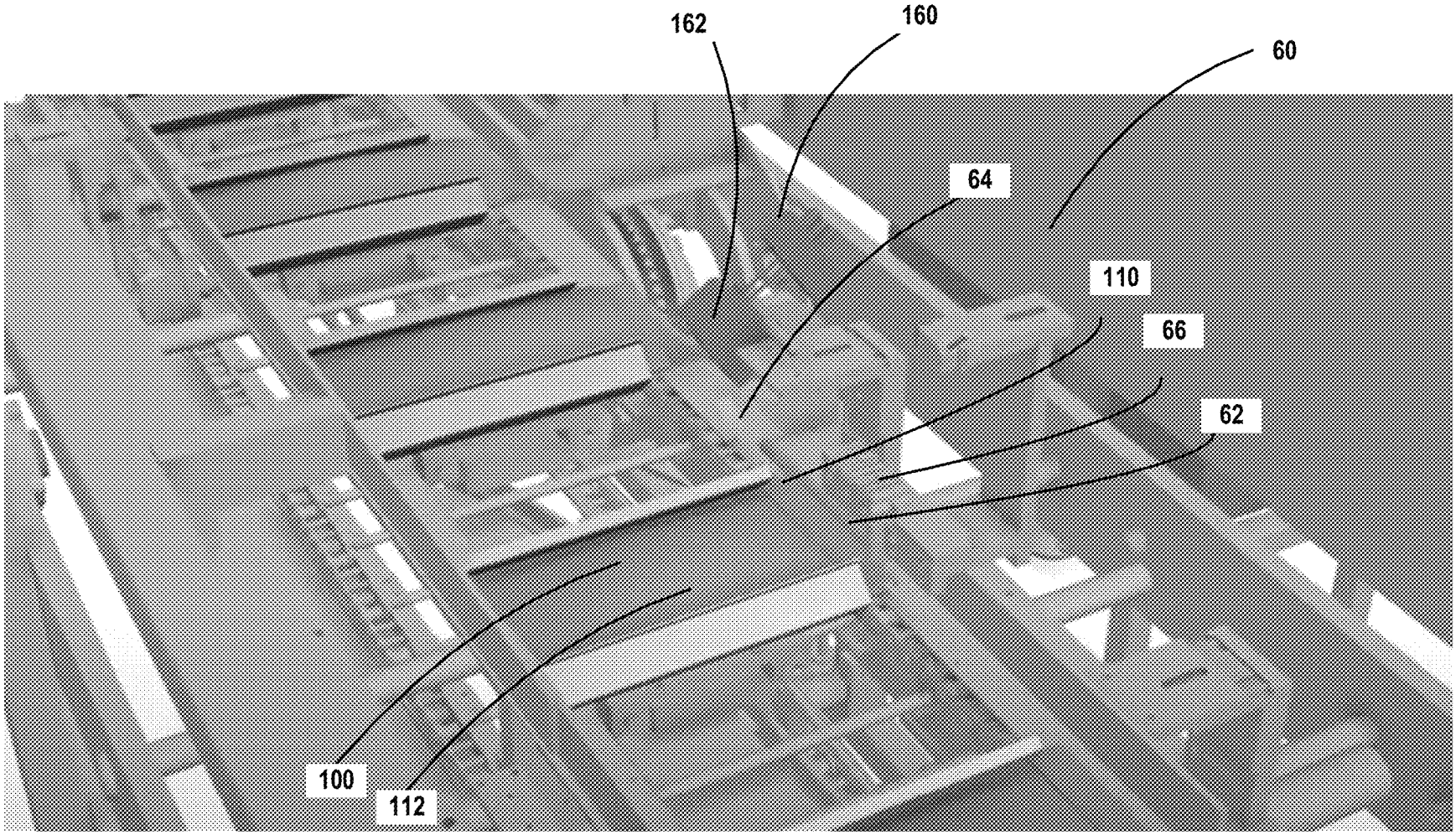
FIG. 14 is a perspective view of a mailer closing station of the mailer machine with an internal member being removed from the mailer after closing, in accordance with embodiments of the present disclosure.

In some embodiments of the invention, after the robot 32 picks the mailer 100 from magazine 22 places it in the packaging station 40, such as in a mailer pocket 46, the packaging station 40 may be in position for receiving a product. However, as illustrated in FIGS. 4, 5A, and 6, the packaging station 40 may be moved from a mailer receipt position to a product receipt position. For example, after the mailer pocket 46 receives the mailer 100, the mailer transfer system 48 (e.g., conveyor, or the like) may move the mailer pocket 46 adjacent to the product supply station 50. It should also be understood that the mailer 100 may be opened, as previously described herein by the mailer packaging system 42, before, during, or after being moved to adjacent the product supply station 50.

As illustrated in FIGS. 6-9, the product supply station 50 may comprise a stationary or moveable location that receives products and then transfers the products into the mailer 100 at the packaging station 40. For example, the product supply station 50 may move products to a position adjacent a mailer 100 for packaging. As will be described in further detail herein, the packaging station 40 and/or the product supply station 50 may be moveable in order to allow the mailer machine 10 to select the proper mailer 100 with the proper attributes (e.g., size, configuration, or other attributes) based on the product to be packaged. As such, the product supply station 50 may comprise one or more receptacles 52. A product positioning system 54 may be utilized to locate the product within the receptacles 52. For example, the product positioning system 54 may comprise one or more walls 56 and a receptacle actuator 58 that is used to adjust the one or more walls 56 in order to locate the product before the product is packed within the mailer 100. It should be understood that the product positioning system 54 may be a single system that locates the product when each receptacle 52 is in a product packaging location adjacent the mailer 100 into which the product will be packed. Alternatively, or additionally, each receptacle 52 has its own product positioning system 54 (e.g., one or more moveable walls 56 and a packaging actuator 58) or a portion thereof (e.g., one or more moveable walls 56 in each receptacle 52 and a universal packaging actuator 58 for all receptables 54, or the like). Furthermore, the product supply station 50, may further comprise a product packaging system 150 comprising a product pusher 152 (e.g., product pusher arm, sled, finger, or the like) and one or more product pusher actuators 154 (e.g., pneumatic, electromechanical, motorized, hydraulic, or the like). The one or more product pusher actuators 154 may extend and retract the pusher 152 in the vertical and/or horizontal directions to locate the product pusher 152 at the proper location for packaging the mailer 100 with the product. As such, the product packaging system 150 may be used to push the product from the receptacle 52 into the open mailer 100 located in the packaging station 40, such as the dynamic mailer pocket 46 in some embodiments of the invention. After being pushed into the mailer 100, the product supply system 150 may be retracted, for example the product pusher actuator 154 retracts the product pusher 152 and/or the receptacle actuator 58 of the product supply station 50 returns the one or more moveable walls 56 of the receptacle 52 to a position to receive another product. As illustrated in the figures, after the product is pushed out of the receptacle 52, the receptacle 52 may be returned to a different location to receive a new product (e.g., a conveyer may move the receptacle 52 to the beginning of the conveyor to receive a new product).

In alternate embodiments, the one or more receptacles 52 may be tilted in order to allow the product to slide into the open mailer 100. In other embodiments, at least a portion of the one or more receptacles 52 may be extended into the open mailer 100 in order to deposit the product into the mailer 100. In alternate embodiments, the product may be packed into the mailer 100 through the use of another process.

After the product is inserted into the mailer 100, the packaging station 40, such as the mailer pocket 46, may be moved into a closing position at the mailer closing station 60. It should be understood that either before, during, or after the packaging station 40 (e.g., the mailer pocket 46) is moved adjacent to the mailer closing station 60, the pocket adjustment system 142 may release the mailer 100 to allow the mailer 100 to at least partially shut. For example, a pocket actuator system 145 may expand the first pocket portion 140 and/or the second pocket portion 141 such that the mailer 100 is at least partially unsqueezed and the opening of the mailer is at least partially closed.

FIGS. 10-14 illustrate the mailer 100 located in the closing position adjacent the closing station 60. The closing station 60 may be utilized to close the mailer 100 by folding the lip 110 of the mailer 100 and operatively coupling it to a portion of the mailer 100. For example, in the illustrated embodiment, the closing station 60 may comprise an external member, such as a closing member 62 (e.g., a closing plate, or the like) and an internal member, such as a tuck member 64 (e.g., tuck bar, or the like). The tuck member 64 may be located over a portion of the lip 110 of the mailer 100, such as placed over the mailer 100 or as the mailer 100 is moved under the tuck member 64. Moreover, the closing member 62 may move through the use of a closing actuator 66 to fold the lip 110 of the mailer 100 over the tuck member 64 for operatively coupling with an outer surface 112 of the mailer 100. It should be understood that the lip 110 of the mailer 100 may be operatively coupled to the outer surface 112 of the mailer through the use of a coupling, such as an adhesive (e.g., glue, water activated, or the like), tape (e.g., having a removeable strip, applied as a two-sided tape, or the like), mechanical coupling, or the like using a coupling system 160. In the illustrated embodiments, the coupling system 160 comprises a glue applicator 162 (e.g., a glue gun, or the like) that applies glue to the lip 110 or the outer surface 112 of the mailer 100 as the mailer 100 passes the coupling system 160 during the movement of the mailer 100 to the closing station 60. In other embodiments, the glue may be applied to the mailer 100 before the mailer 100 leaves the product supply station 50 or after the mailer 100 is located in the closing location at the closing station 60. The closing member 62 may apply pressure to the lip 110 in order to create the coupling between the lip 110 and the outer surface 112 of the mailer 100 to close the mailer 100. Once the mailer 100 is closed, in the illustrated embodiment, as the mailer 100 is moved from the closing station 60 (e.g., through the mailer transfer system 48 of the packaging station 40) to the mailer discharge station 70, the tuck member 64 may be removed from the mailer 100.

In other embodiments of the invention, the closing station 60 may close the mailer 100 in other ways. For example, a portion of the mailer 100 may be folded over without the need of the tuck member 64 (e.g., flexible material may not require a bar), flaps and/or inside surfaces may be sealed together, or the mailer 100 may be closed in other ways.

Figure 15:
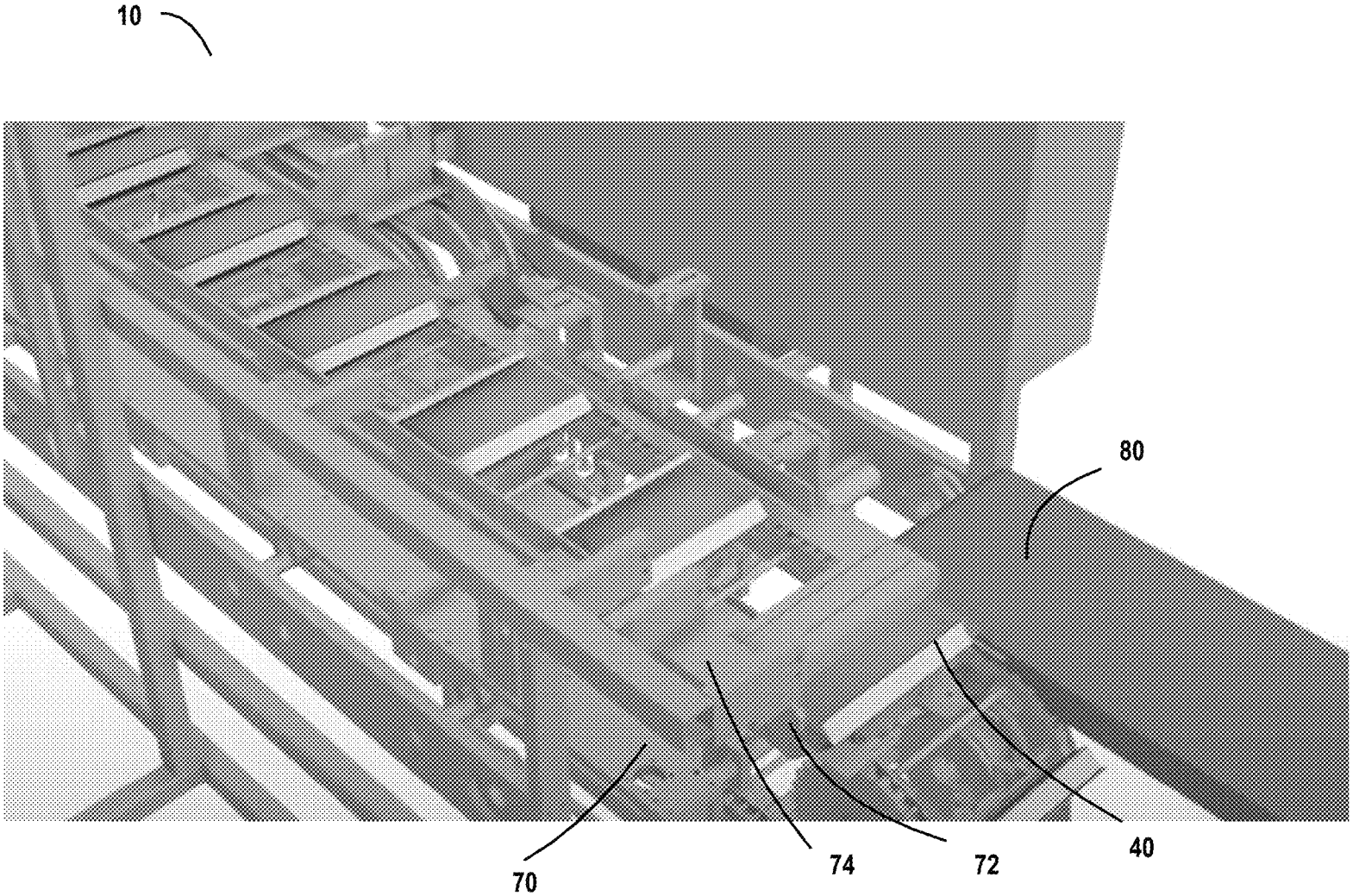
FIG. 15 is a perspective view of a mailer discharge station of the mailer machine with a mailer in position to be removed from the packaging station, in accordance with embodiments of the present disclosure.
Figure 16:
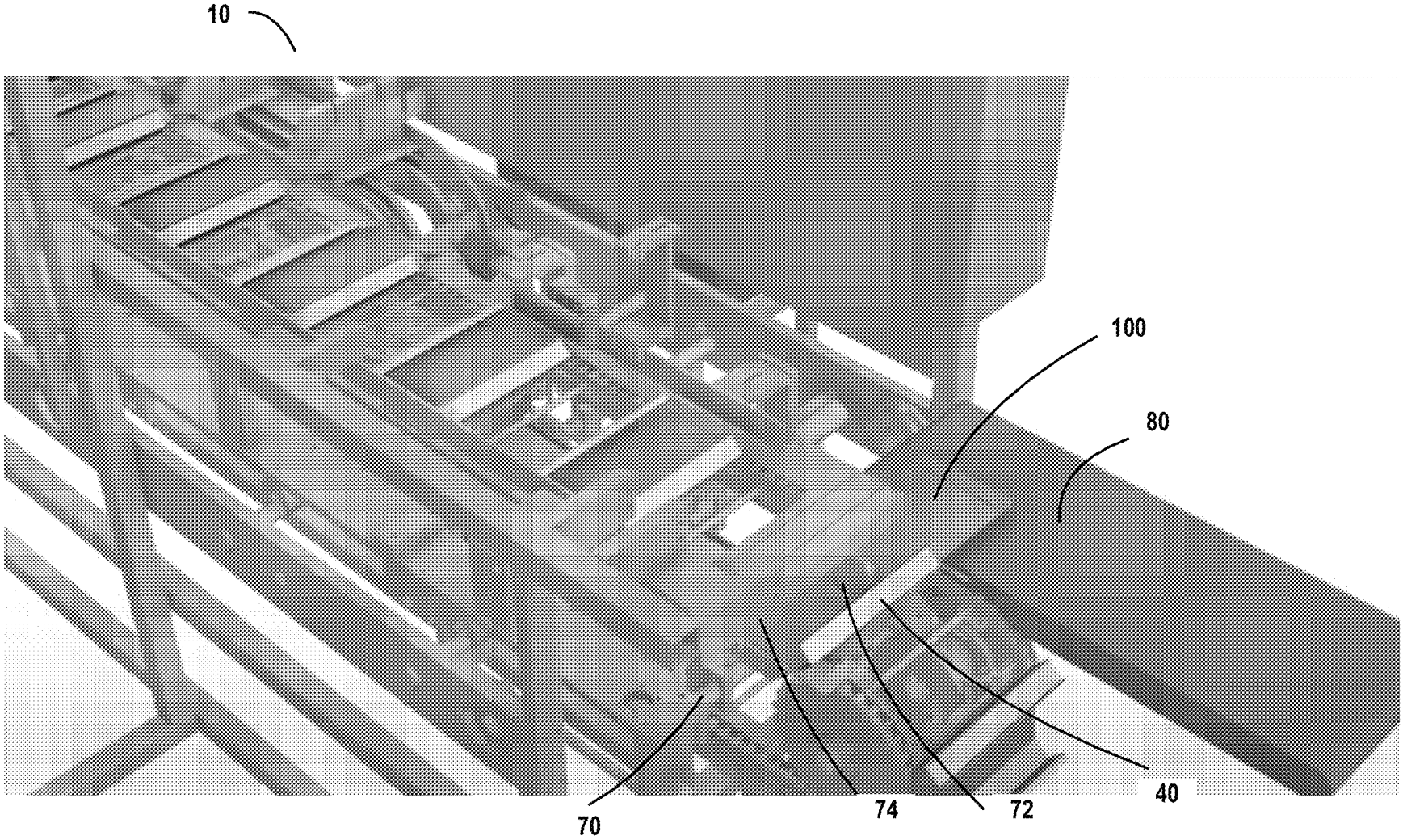
FIG. 16 is a perspective view of a mailer discharge station of the mailer machine with a mailer pusher for discharging the mailer out of the packaging station, in accordance with embodiments of the present disclosure.
Figure 17:
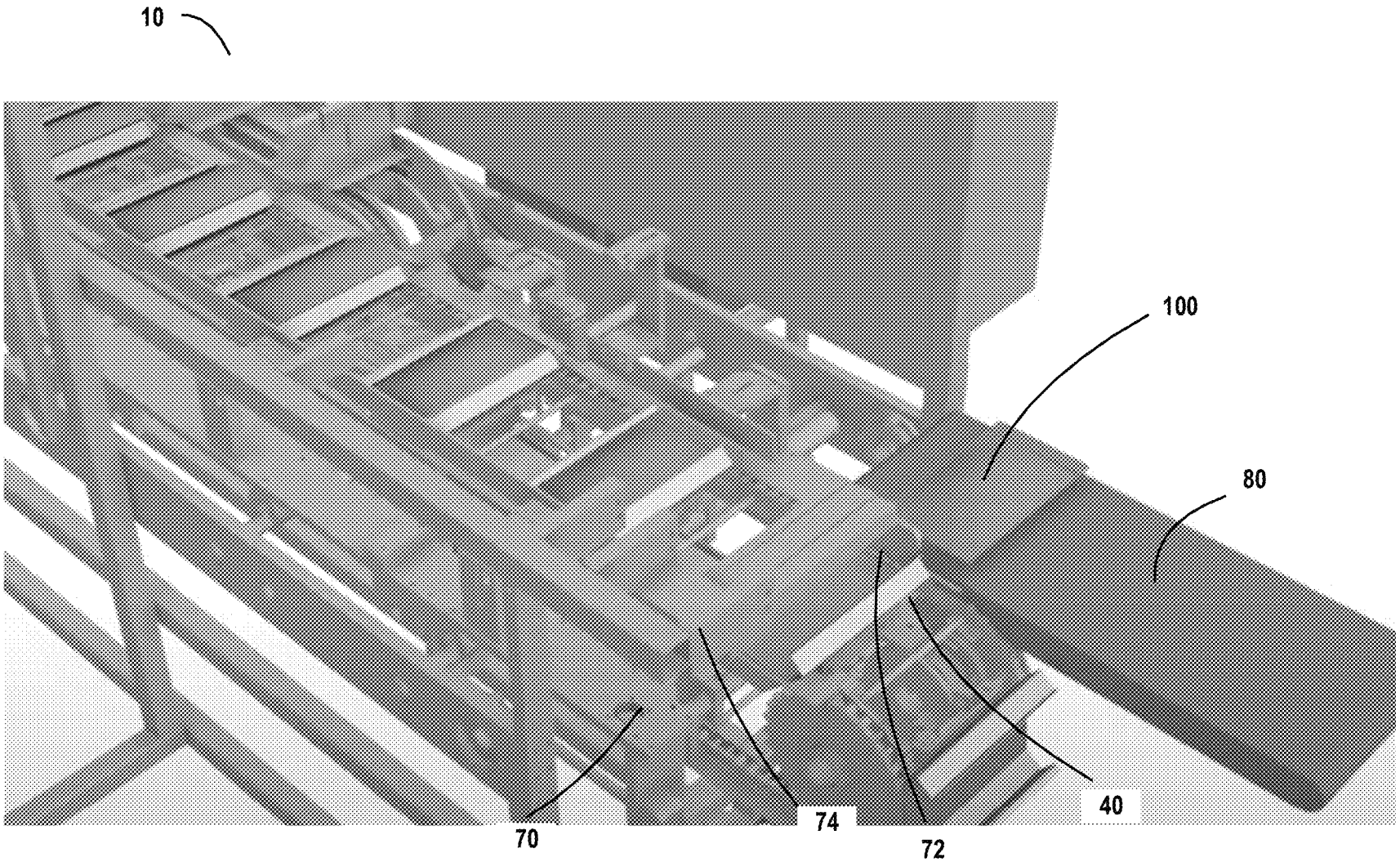
FIG. 17 is a perspective view of a mailer discharge station of the mailer machine with the mailer moved onto a transport station for further processing, in accordance with embodiments of the present disclosure.
Figure 18:
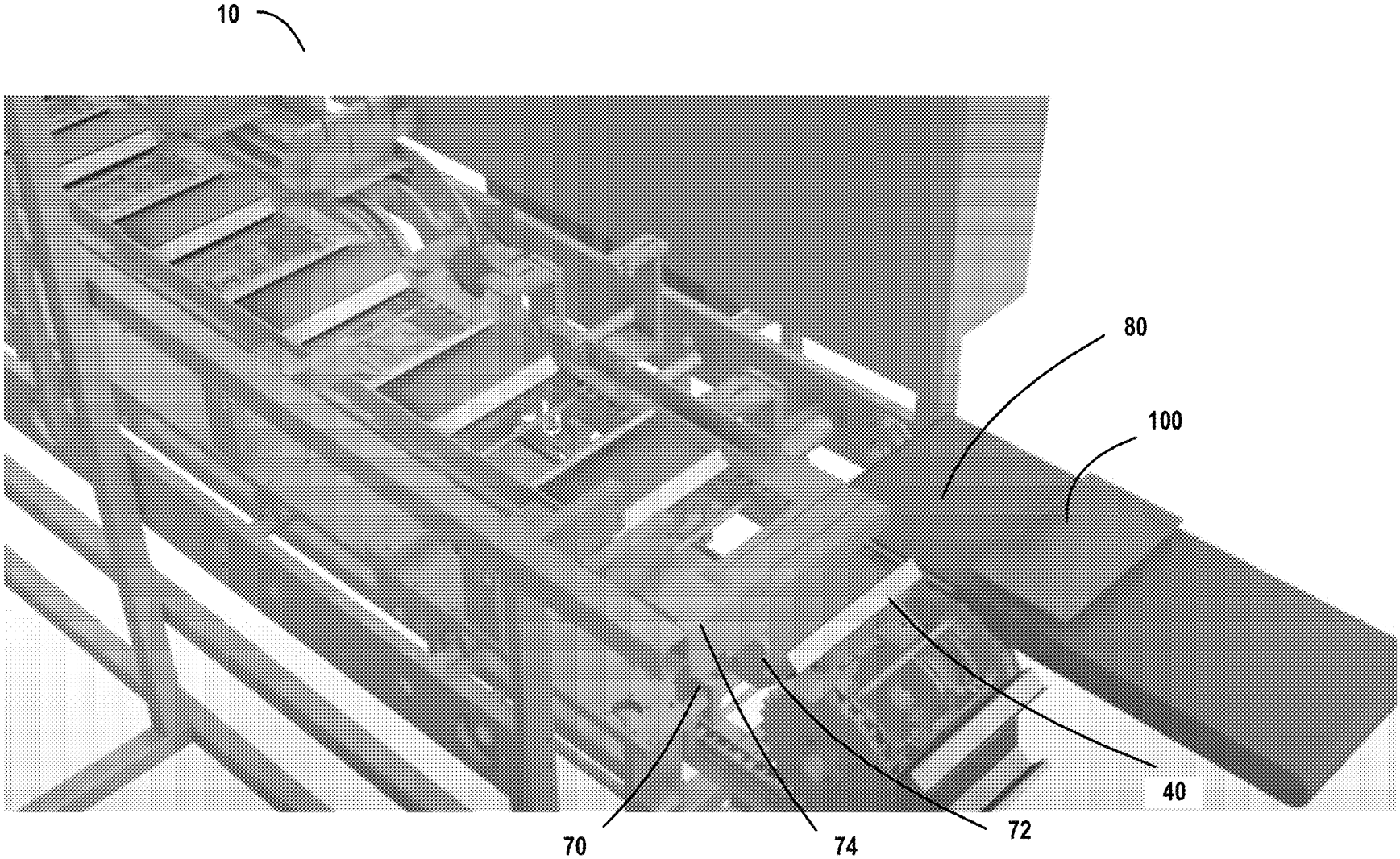
FIG. 18 is a perspective view of a mailer discharge station of the mailer machine with the transport station moving the mailer for further processing, in accordance with embodiments of the present disclosure.

The mailer discharge station 70 is used to remove the mailer 100 from the packaging station 40, such as the from the mailer pocket 46, in order to send the mailer 100 for further processing. In some embodiments, the mailer discharge station 70 comprises a mailer pusher 72 and a mailer pusher actuator 74. As illustrated in FIGS. 15-17, the mailer pusher actuator 74 extends the mailer pusher 72, which discharges the mailer 100 from the packaging station 40, such as from the mailer pocket 46 and onto a transport system 80 (e.g., conveyer, rollers, belts, tracks, slides, or the like) for moving the mailer 100 for further processing.

It should be understood that the mailer machine 10 may have one or more additional stations that are not specifically illustrated in FIGS. 1-18. For example, the mailer machine 10 may comprise one or more product sensors located within, or upstream of, the product supply station 50. For example, the one or more product sensors may be utilized to determine what product is being received for packaging within the mailer 100, and thus, what mailer 100 and/or magazine 22 should be provided for the product identified. The one or more product sensors may include a camera, infrared, laser, scale, RFID, near-field communication, or the like sensor, that can be used to determine the product (e.g., actual product, product type, product size, product weight, or the like) in order to determine the mailer 100 for packaging the product.

In other embodiments, the mailer machine 10 may include a labeling station that is used to label the mailer 100 for shipping. The labeling station may be located anywhere within or outside of the mailer machine 10. The labeling station may comprise a label applicator (e.g., for coupling a label to the mailer 100), printer (e.g., ink, thermal, laser, or the like), one or more label sensors (e.g., for determining where to place the label and/or print the information), or the like. It should be understood that the labeling station may apply a new label with characters (e.g., a shipping addresses, or the like), may apply characters (e.g., a shipping address, or the like) to a label that is pre-applied to the mailer 100, may print characters (e.g., a shipping address, or the like) on a surface 112, 113 of the mailer 100, and/or the like. The labeling station may apply the label to the mailer 100 before, during, or after the product is packaged into the mailer 100. Furthermore, the labeling applied may include characters with a shipping address, may include a barcode (e.g., for further processing within the facility by other machines), QR-code, branding information, or the like.

In other embodiments, the mailer machine 10 may further include a verification station, which may comprise one or more verification sensors (e.g., a camera, infrared, or the like) that may be used to verify that the product has been correctly packaged in the mailer 100, the mailer 100 has been properly sealed, the label applied to the mailer 100 is correct, or the like.

It should be understood that one or more other sensors may be utilized generally within the mailer machine 10 and/or the components thereof for various purposes, such as but not limited to security, safety, supply, identifying the location of components of the mailer machine 10, and/or identification, positioning, and/or movement a mailer 100, or the like. The one or more sensors may be any type of sensor, such as a light curtain, camera, radar, infrared, laser, accelerometer, force, radio frequency identification (RFID), pressure sensor, or the like. For example, the mailer machine 10 may comprise one or more safety sensors that are configured to identify when an object (e.g., a user, equipment, or the like) enters a zone (e.g., a distance from, within, crossing a boundary of one of the stations, such as a mailer supply station 20, the handling station 30, or the like) that the object should not be in, such as when the mailer machine 10 is operating. In some embodiments, one or more magazine sensors may be utilized in order to determine the location of a magazine with respect to the magazine picking location and/or with respect to the location of the robot 32. In some embodiments, a mailer sensor may be utilized to identify the location of a mailer 100 (e.g., an upper most mailer in a stack) in one or more of the magazines 10, such as when a mailer 100 is located at the pre-determined pick-up position. Additionally, one or more robot sensors may be utilized to determine the position of the robot 32 or a component thereof (e.g., the hand, a suction component, or the like), the force with which a robot may be contacting an object (e.g., a mailer, or the like), or the like.

Figure 19:
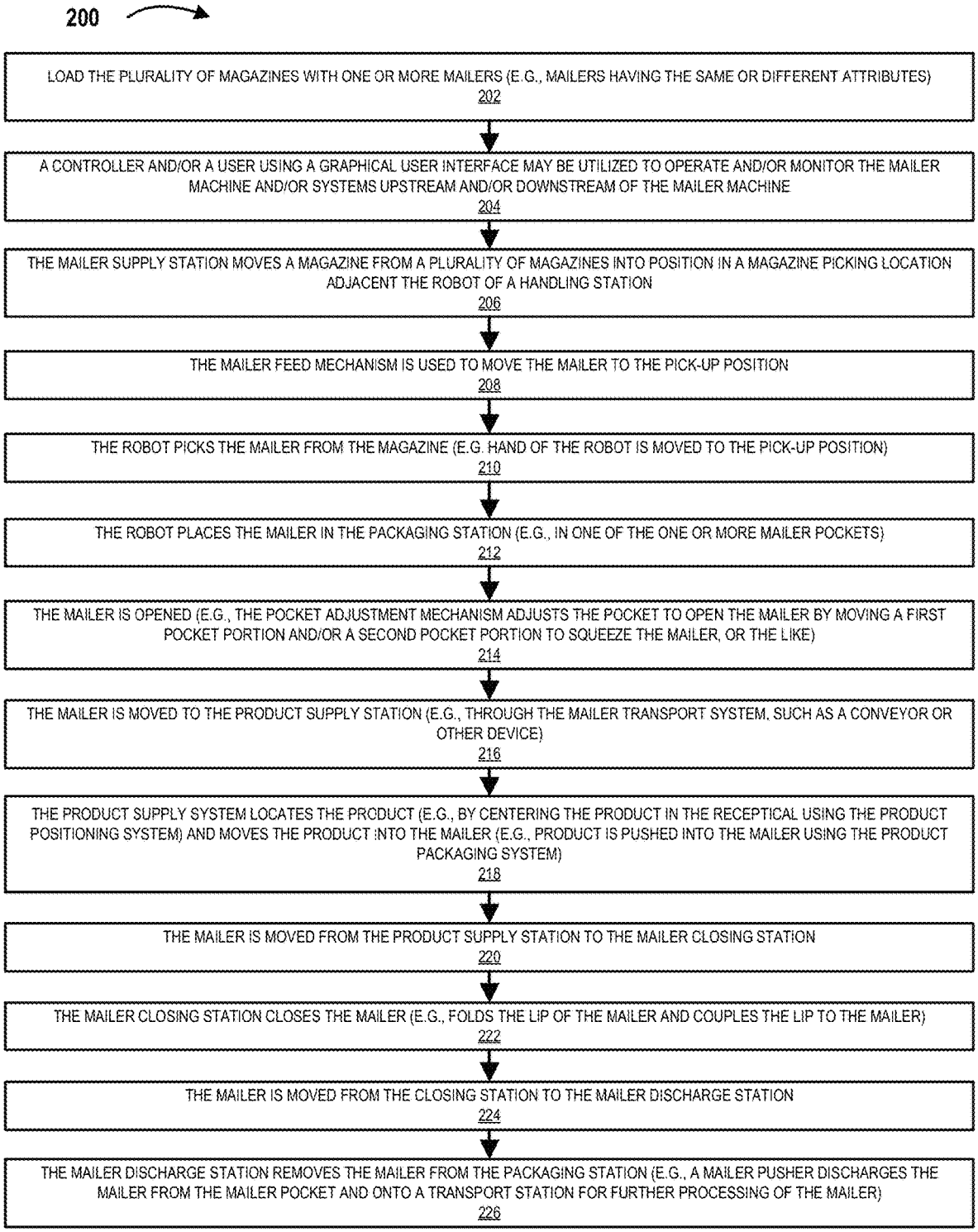
FIG. 19 provides a process flow for using the mailer machine for packaging products in a mailer, in accordance with embodiments of the present disclosure.

FIG. 19 provides a method of selecting, picking, opening, filling, and/or closing a mailer 200. As illustrated by block 202 of FIG. 15, the plurality of magazines 22 are supplied with two or more types of mailers 100, such as two or more mailers having different attributes, such as mailers of different sizes, types, graphics, openings and/or closings locations, or the like. The magazines 22 may be manually and/or automatically adjusted for different sizes, and/or manually and/or automatically supplied with one or more stacks of mailers 100 having the same or different attributes. Moreover, in some embodiments entire magazines 22 may be pre-loaded and swapped out as requested. In some embodiments, the magazines 22 may be loaded with the mailers 100 when the magazines 22 are located in one or more loading stations 19. As illustrated in the figures, one or more magazines 22 may be loaded from loading stations 19 located on the outside of the mailer supply station 20, such as outside of the annular base 24 of the mailer supply station 20.

Block 204 of FIG. 19 further illustrates that the controller 90 and/or the graphical user interface 92 may be used to automatically and/or manually make selections of one or more operating parameters of the mailer machine 10, such as the mailer attributes, sequence of mailer use, number of mailers, product for filing the mailers, amount of product to fill the mailer, operating speed, operating duration, or the like. The controller 90 and/or user interfaces 92 will be described in further detail below; however, it should be understood that the controller 90 may be part of one or more mailer systems 10, and may communicate with other systems within (e.g., multiple product systems supplying different products) or outside of the facility (e.g., for remote monitoring, operation, or the like).

As illustrated by block 206 of FIG. 19, the mailer supply station 20 moves a magazine 22 from the two or more magazines 22 into a position adjacent to the robot 32 in a magazine picking location (e.g., adjacent a first arm 35 of the robot 32) for allowing access to the mailers 100 by the hand 37 of the robot 32. In some embodiments, a magazine location sensor, as previously described herein, may be utilized to determine when the magazine 22 with the requested mailer 100 is located in the magazine picking location.

Block 208 further illustrates that the mailer feed mechanism is used to move the mailer 100 to a pick-up position (e.g., a pre-determined pick-up position). For example, the elevator mechanism 34 engages with the support member 26 (e.g., support plate) to move the mailers 100 to the pre-determined pick-up position, as illustrated in FIG. 2. The pre-determined pick-up position may be the same location each time the robot 32 picks a mailer 100 from any of the magazines 22 in order to allow for repeatability and improved accuracy for the robot 32 picking mailers 100. In the illustrative embodiment, a single elevator mechanism 34 is used to engage with the magazine 22 positioned adjacent to the robot 32 and move the mailers 100 to the pick-up position. In some embodiments, each magazine 22 is provided with its own mailer feeder mechanism (e.g., dedicated elevator mechanism 34).

Block 210 illustrates that the hand 37 of the robot 32 is moved to the predetermined pick-up position to engage with the mailer 100. As previously discussed herein, the hand 37 of the robot 32 may pick the mailer 100 through the use of one or more suction components 38, as previously discussed herein; however, other types of grippers may be used to pick the mailer 100.

FIG. 19 further illustrates in block 212 that the mailer 100 is placed in the packaging station 40, and in particular, in a mailer pocket 46 of the packaging station 40.

Block 214 further illustrates that the mailer may be opened, such as through a first pocket portion 140 and/or a second pocket portion 141 moving through the use of the pocket adjustment system 142 as previously described herein.

Block 216 of FIG. 19 indicates that the packaging station 40 moves the mailer 100, such as through the mailer transport system 48, to a position adjacent the product supply station 50.

Block 218 of FIG. 19 indicates that the product supply station, such as through the product positioning system 54 locates the product for packaging with the mailer 100 (e.g., centers the product in the receptacle 52). Moreover, the product supply station, such as through the product packaging system 150, packages the product within the mailer 100 (e.g., using a product pusher to push the product into the mailer).

FIG. 19 further illustrates in block 220, that the mailer 100 is moved from the product supply station 50 to adjacent the mailer closing station 60, such as through the use of the mailer transport system 48. Either before, during, or after moving the mailer 100 from the product supply station 50 to the mailer closing station 60, the mailer 100 may be at least partially shut, such as through a first pocket portion 140 and/or a second pocket portion 141 moving through the use of the pocket adjustment system 142, as previously described herein.

Block 222 of FIG. 19 illustrates that the mailer closing station closes the mailer 100. For example, as previously discussed herein a closing member 62 (e.g., a closing plate, or the like) folds the lip 110 of the mailer 100 over a tuck member 64 (e.g., tuck bar, or the like). The lip 110 of the mailer 100 may be operatively coupled to the outer surface 112 of the mailer through the use of a coupling, such as an adhesive (e.g., glue, water activated, or the like), tape (e.g., having a removeable strip, applied as a two-sided tape, or the like), mechanical coupling, or the like using a coupling system 160. The coupling system 160 may comprise a glue applicator 162 (e.g., a glue gun, or the like) that applies glue to the lip 110 or the outer surface 112 of the mailer 100 as the mailer 100 passes the coupling system 160 during the movement of the mailer 100 to the closing station 60 or while the mailer 100 is in the mailer closing station 60.

FIG. 19 further illustrates in block 224, that the mailer is moved from the mailer closing station 60 to adjacent a mailer discharge station 70, such as through the use of the mailer transport system 48. Either before, during, or after moving the mailer 100 from the mailer closing station 60 to the mailer discharge station 70, the tuck member 64 may be removed from the mailer 100.

Block 226 of FIG. 19 illustrates that the mailer discharge station 70 is used to remove the mailer 100 from the packaging station 40. For example, a mailer pusher 72 may be moved by a discharge actuator 74 in order to discharge the mailer 100 from a mailer pocket 46 and to a transport station 80. The transport station 80 may be utilized for further processing (e.g., labeling, sorting, mailing, or the like) of the mailer 100.

The present invention disclosed herein has improvements over conventional mailer systems. For example, by moving the magazines, in particular the rotational movement, with respect to the robot 32 (e.g., robot fixed end does not move), and having the single known pick-up position for the robot 32 to pick a mailer 100 reduces complexity, improves efficiency of the pick-up process, including the programmed operation of the robot 32, and minimizes the size of the mailer supply station 20 and the handling station 30 (including the robot 32), while providing mailers 100 having different attributes without having to shut down the mailer machine 10 (e.g., to change out magazines with different mailers 100). Conventional mailer machines may include multiple magazines of mailers having the same or different attributes, however, the magazines are arranged across a large staging area or holding area. For example, two or more magazines are arranged in racks in a staging area surrounding the mailer machine, whereby the machine's robot must traverse a considerable distance to move across the staging area to access the magazines containing different mailers 100. This traversal process takes the robot 32 considerable time and requires a large footprint that consumes valuable workspace by the robot and the mailer machine. Also, when a magazine is emptied of a particular mailer, the re-loading process by a human operator takes a considerable amount of time and effort. These limitations reduce the desirability and efficiency of conventional mailer machines.

Figure 20:
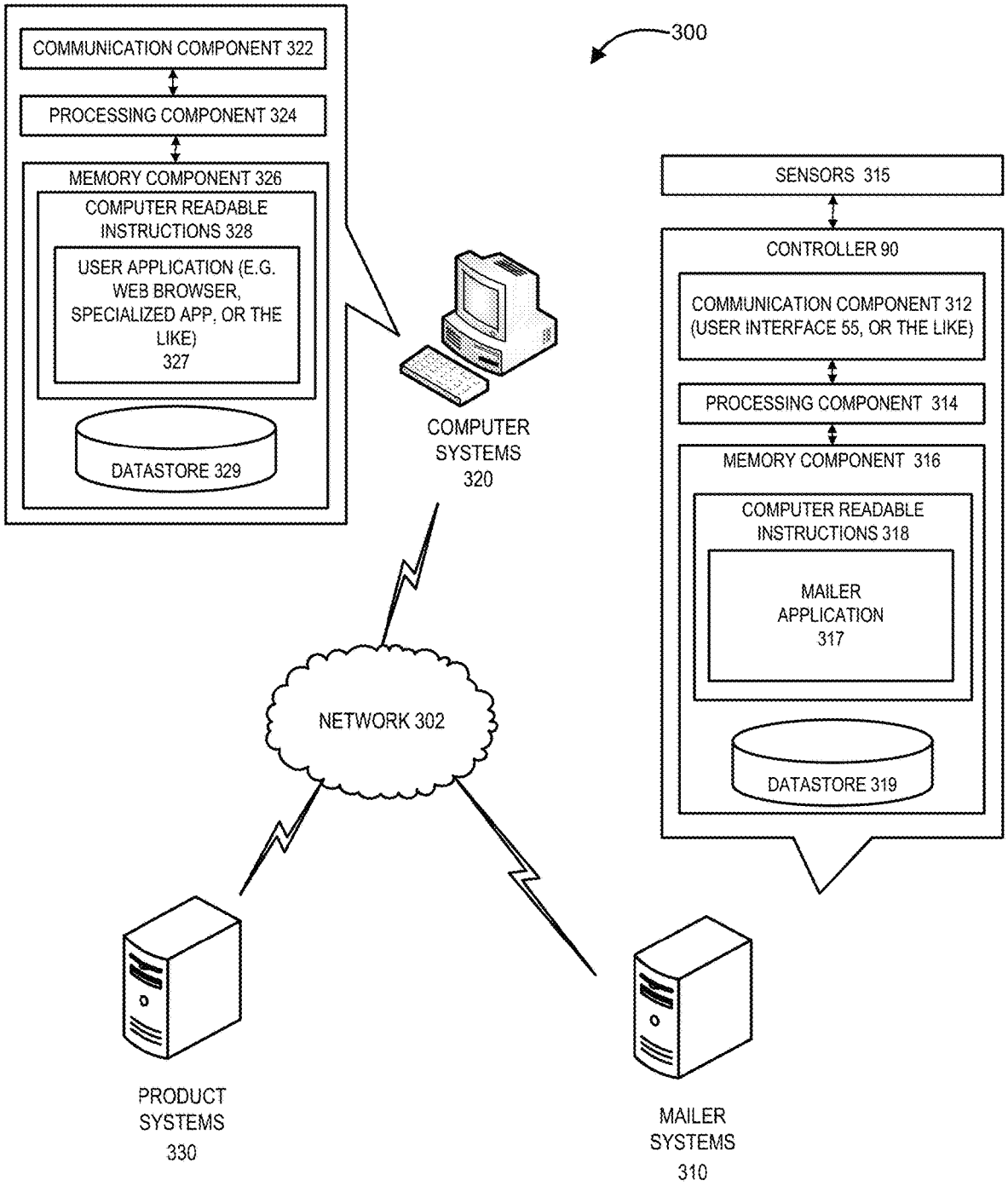
FIG. 20 provides a schematic diagram for a mailer machine network for operating the mailer machine and/or communicating with other systems within a facility, in accordance with embodiments of the present disclosure.

The operation of the mailer machine 10, including the mailer supply station 20, the handling station 30 with the robot 32, the packaging station 40, the product supply station 50, the closing station 60, the mailer discharge station 70, the mailer transport station 80, labeling stations, verification stations, or other like stations, are controlled by a programmable controller 50, which may communicate with the various stations of the mailer machine 10 and/or other systems within a facility. As such, FIG. 20 illustrates a mailer network system 300, in accordance with embodiments of the present disclosure. As illustrated in FIG. 20, one or more mailer systems 310 are operatively coupled, via a network 302, to one or more user computer systems 320, one or more product systems 330, and/or one or more other systems (not illustrated). In this way, the mailer systems 310 operating the mailer machine 10 may communicate with one or more product systems 330 and/or product sensors 315 for identifying and/or receiving products for selection of the mailers 100 for the mailer machine 10. The mailer systems 310 may communicate with user computer systems 20 to allow the user computer systems 320 to monitor the mailer machine 10. Moreover, the mailer systems 310 may communicate with other systems, such as mailer supply systems (not illustrated) to request mailers when a determination is made that the magazines 22 require additional mailers 100 for the mailer machine 10. The communications may occur over a network 302, as will be described in further detail herein.

The network 302 may be a global area network (GAN), such as the Internet, a wide area network (WAN), a local area network (LAN), or any other type of network or combination of networks. The network 302 may provide for wireline, wireless, or a combination of wireline and wireless communication between systems, services, components, and/or devices on the network 2.

As illustrated in FIG. 20, the one or more mailer systems 310 may comprise a controller 90 that may generally comprise one or more communication components 312, one or more processing components 314, and one or more memory components 316. The one or more processing components 314 are operatively coupled to the one or more communication components 312, and the one or more memory components 316. As used herein, the term "processing component" generally includes circuitry used for implementing the communication and/or logic functions of a particular system. For example, a processing component may include a digital signal processor component, a microprocessor component, and various analog-to-digital converters, digital-to-analog converters, and other support circuits and/or combinations of the foregoing. Control and signal processing functions of the system are allocated between these processing components according to their respective capabilities. The one or more processing components may include functionality to operate one or more software programs based on computer-readable instructions thereof, which may be stored in the one or more memory components.

The controller 90 components, such as the one or more communication components 312, may be operatively coupled to the one or more sensors 315 (e.g., safety sensors, supply sensors, location sensors, or the like as previously discussed herein) located within, upstream, and/or downstream of the mailer machine 10.

The one or more processing components 314 use the one or more communication components 312 to communicate with the network 302 and other components on the network 302, such as, but not limited to, the components of the one or more user computer systems 320, the one or more product systems 330, and/or the one or more other systems (not illustrated). As such, the one or more communication components 312 generally comprise a wireless transceiver, modem, server, electrical connection, electrical circuit, or other component for communicating with other components on the network 302. The one or more communication components 312 may further include an interface that accepts one or more network interface cards, ports for connection of network components, Universal Serial Bus (USB) connectors, or the like. Moreover, the one or more communication components 312 may include a keypad, keyboard, touch-screen, touchpad, microphone, mouse, joystick, other pointer component, button, soft key, and/or other input/output component(s) for communicating with the users. In some embodiments, as described herein the one or more communication components 312 may comprise a user interface, such as a graphical user interface 92 that allows a user to control and/or monitor the operation of the mailer machine 10, upstream systems, and/or downstream systems.

As further illustrated in FIG. 20, the one or more mailer systems 310 comprise computer-readable instructions 318 stored in the one or more memory components 316, which in some embodiments includes the computer-readable instructions 318 of the one or more mailer applications 317 (e.g., used to operate the mailer machine 10 and/or the components thereof, or the like). In some embodiments, the one or more memory components 316 include one or more data stores 319 for storing data related to the mailer machines 10, including, but not limited to, data created, accessed, and/or used by the one or more mailer systems 310 to operate the one or more mailer machines 10.

As illustrated in FIG. 20, users may communicate using the computer systems 320 (e.g., user computer systems 320) with each other over the network 302 and the mailer systems 310, the product systems 330, and/or other systems in order to control and/or monitor the various systems remotely. Consequently, the one or more users 4 may be employees, agents, representatives, officers, or the like of an organization operating the facility. The one or more user computer systems 320 may be a desktop, laptop, tablet, mobile device (e.g., smartphone device, or other mobile device), or any other type of computer that generally comprises one or more communication components 322, one or more processing components 324, and one or more memory components 326.

The one or more processing components 324 are operatively coupled to the one or more communication components 322, and the one or more memory components 326. The one or more processing components 324 use the one or more communication components 322 to communicate with the network 302 and other components on the network 302, such as, but not limited to, the one or more mailer systems 310, the one or more product systems 330, and/or the other systems (not illustrated). As such, the one or more communication components 322 generally comprise a wireless transceiver, modem, server, electrical connection, or other component for communicating with other components on the network 302. The one or more communication components 322 may further include an interface that accepts one or more network interface cards, ports for connection of network components, Universal Serial Bus (USB) connectors, or the like. Moreover, the one or more communication components 322 may include a keypad, keyboard, touch-screen, touchpad, microphone, mouse, joystick, other pointer component, button, soft key, and/or other input/output component(s) for communicating with the users. In some embodiments, the one or more communication components 322 may comprise a user interface, such as a graphical user interface that allows a user to remotely control and/or monitor the operation of the mailer machine 10.

As illustrated in FIG. 20, the one or more user computer systems 320 may have computer-readable instructions 328 stored in the one or more memory components 326, which in some embodiments includes the computer-readable instructions 328 for user applications 327, such as dedicated applications (e.g., apps, applet, or the like), portions of dedicated applications, a web browser or other apps that allow access to applications located on other systems, or the like. In some embodiments, the one or more memory components 326 include one or more data stores 329 for storing data related to the one or more user computer systems 320, including, but not limited to, data created, accessed, and/or used by the one or more user computer systems 320. The user application 327 may use the applications of the one or more mailer systems 310, the one or more product systems 330, and/or one or more other systems (not illustrated) in order to communicate with other systems on the network 302 and take various actions described herein (e.g., operation, use, monitoring, or the like the mailer machine 10).

Moreover, as illustrated in FIG. 20, the one or more product systems and/or other systems (not illustrated) have components the same as or similar to the components described with respect to the one or more mailer systems 310 and the one or more user computer systems 320 (e.g., one or more communication components, one or more processing components, one or more sensors, one or more memory devices with computer-readable instructions of one or more product applications, one or more datastores, or the like). Thus, the one or more product system 330 communicate with the one or more mailer systems 310, the one or more user computer systems 320, and/or one or more other systems in same or similar way as previously described with respect to the one or more mailer systems 310, the one or more user computer systems 320, and/or the one or more other systems. The one or more product systems 330 may comprise the systems that operate the machines that produce and/or supply the one or more products to the mailers created by the one or more mailer machines 10.

As will be appreciated by one of skill in the art in view of this disclosure, embodiments of the invention may be embodied as an apparatus, a system, computer program product, and/or other device, a method, or a combination of the foregoing. Accordingly, embodiments of the invention may take the form of an entirely hardware embodiment, an entirely software embodiment (including firmware, resident software, micro-code, etc.), or an embodiment combining software and hardware aspects that may generally be referred to herein as a "system." Furthermore, embodiments of the invention may take the form of a computer program product comprising a computer-usable storage medium having computer-usable program code/computer-readable instructions embodied in the medium (e.g., a non-transitory medium, or the like).

Any suitable computer-usable or computer-readable medium may be utilized. The computer usable or computer readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires; a tangible medium such as a portable computer diskette, a hard disk, a random access memory (RAM), a read-only memory (ROM), an erasable programmable read-only memory (EPROM or Flash memory), a compact disc read-only memory (CD-ROM), or other tangible optical or magnetic storage device.

Computer program code/computer-readable instructions for carrying out operations of embodiments of the invention may be written in an object oriented, scripted or unscripted programming language such as Java, Pearl, Python, Smalltalk, C++ or the like. However, the computer program code/computer-readable instructions for carrying out operations of the invention may also be written in conventional procedural programming languages, such as the "C" programming language or similar programming languages.

It should be understood that the present invention is described herein with respect to mailers; however, the same or similar components and processes may be used with respect to other types of packaging besides mailers (e.g., cartons, material that is wrapped around a product, preformed containers, containers that require forming, bags, or other like packaging). As such, the term packing, and/or more specific descriptions of packaging, could replace the term mailer 100 herein, and the machine 10 and/or the process of using the machine could operation in the same or similar way.

Several alternative examples have been described and illustrated herein. A person of ordinary skill in the art would appreciate the features of the individual embodiments and the possible combinations and variations of the components. A person of ordinary skill in the art would further appreciate that any of the examples could be provided in combination with the other examples disclosed herein. Additionally, the terms "first," "second," and "third" as used herein are intended for illustrative purposes only and do not limit the embodiments in any way.

As used herein, the singular forms "a", "an" and "the" are intended to include the plural forms as well, unless the context clearly indicates otherwise. It will be further understood that the terms "includes" and/or "including" when used herein, specify the presence of stated features, steps, operations, elements, and/or components, but do not preclude the presence or addition of one or more other features, steps, operations, elements, components, and/or groups thereof.

It will be understood that when an element is referred to as being "engaged," "coupled," or "operatively coupled" (other similar phrase) to another element, the elements can be formed integrally with each other, or may be formed separately and put together. Furthermore, "engaged," "coupled," or "operatively coupled" to can mean the element is directly engaged, coupled, or operatively coupled to the other element, or intervening elements may be present between the elements. Furthermore, "engaged," "coupled," or "operatively coupled" may mean that the elements are detachable from each other, or that they are permanently held together.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and should not be interpreted in an idealized or overly formal sense unless expressly so defined herein. Certain terminology is used herein for convenience only and is not to be taken as a limitation on the invention. For example, words such as top, bottom, front, rear, side, upper, lower, left, right, horizontal, vertical, upward, and downward merely describe the configuration shown in the figures. The referenced components may be oriented in an orientation other than that shown in the drawings and the terminology, therefore, should be understood as encompassing such variations unless specified otherwise. All structural and functional equivalents to the elements of the various aspects described throughout the disclosure that are known or later come to be known to those of ordinary skill in the art are expressly incorporated herein by reference and are intended to be encompassed by the claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, the subject matter lies in less than all features of a single disclosed configuration or operation. The claims are hereby incorporated into the detailed description, with each claim standing on its own as a separately claimed subject matter.

What is claimed is:

1. A mailer packaging apparatus comprising:

a handling station having a robot;

a mailer supply station having a plurality of magazines configured to hold mailers, the plurality of magazines having a first magazine configured to hold a plurality of first mailers and a second magazine configured to hold a plurality of second mailers, and wherein the plurality of magazines are movable with respect to the robot;

a packaging station configured to receive the mailers and transfer the mailers to a product supply station and to a closing station after receiving products from the product supply station;

a controller operatively coupled to the handling station, the mailer supply station, and the packaging station, wherein the controller is configured to operate the handling station, the mailer supply station, and the packaging station to:

receive an indication of a product from a product delivery system being received in the mailer packaging apparatus;

identify a mailer for the product being received from the plurality of magazines holding the mailers; and in response to identifying the mailer, activate the mailer supply station and the robot to pick the mailer from the plurality of magazines for the product and deliver it to the packaging station.

2. The mailer packaging apparatus of claim 1, wherein the mailer supply station comprises a rotating support, wherein the plurality of magazines are operatively coupled to the rotating support, and wherein the plurality of magazines rotate with respect the robot.

3. The mailer packaging apparatus of claim 2, wherein the handling station is located adjacent the mailer supply station, and wherein the first magazine of the plurality of magazines of the mailer supply station is located in a picking location adjacent the robot of the handling station.

4. The mailer packaging apparatus of claim 1, wherein the handling station further comprises:

a mailer feeder mechanism, wherein the mailer feeder mechanism is configured to move a mailer in the first magazine to a pre-determined pick-up position for the robot to pick the mailer from the first magazine.

5. The mailer packaging apparatus of claim 4, wherein the mailer feeder mechanism comprises:

an elevator mechanism, wherein the elevator mechanism elevates the plurality of first mailers in the first magazine such that the mailer moved to the pre-determined pick-up position is an upper most mailer in the first magazine.

6. The mailer packaging apparatus of claim 5, wherein the mailer feeder mechanism comprises:

a pick-up position sensor, and wherein the mailer feeder mechanism moves the mailer to the pre-determined pick-up position based on feedback from the pick-up position sensor.

7. The mailer packaging apparatus of claim 1, wherein the packaging station comprises:

a mailer transfer system; and a plurality of mailer pockets operatively coupled to the mailer transfer system, wherein the plurality of mailer pockets receive the mailers;

wherein the mailer transfer system transports the plurality of mailer pockets successively to the product supply station.

8. The mailer packaging apparatus of claim 1, wherein the packaging station comprises:

a plurality of mailer pockets, wherein each of the plurality of mailer pockets are configured to actuate from a mailer receipt position to a mailer open position, wherein in the mailer open position the mailers are configured to receive a product.

9. The mailer packaging apparatus of claim 8, wherein the plurality of mailer pockets each comprise:

a first pocket portion;

a second pocket portion; and a pocket adjustment system operatively coupled to the first pocket portion or the second pocket portion; and wherein the first pocket portion moves relative to the second pocket portion to move from the mailer receipt position to the mailer open position.

10. The mailer packaging apparatus of claim 9, wherein the pocket adjustment system comprises:

a first slide operatively coupled to the first pocket portion;

a second slide operatively coupled to the second pocket portion;

one or more tracks operatively coupled to the first slide and the second slide;

one or more drive members operatively coupled to the first slide and the second slide; and one or more drives operatively coupled to the one or more drive members;

wherein the one or more drives are configured to move the first pocket portion with respect to the second pocket portion.

11. The mailer packaging apparatus of claim 1, further comprising:

the product supply station;

wherein the product supply station supplies products to openings of the mailers.

12. The mailer packaging apparatus of claim 11, wherein the product supply station comprises:

one or more product receptacles; and a product positioning system operatively coupled to the one or more product receptacles;

wherein the product positioning system locates the products in the one or more product receptacles before packaging in the mailers.

13. The mailer packaging apparatus of claim 12, wherein the one or more product receptacles comprise:

a first wall; and a second wall;

wherein the product positioning system is configured to move the first wall or the second wall with respect to each other to locate the products in the one or more product receptacles before packaging in the mailers.

14. The mailer packaging apparatus of claim 11, wherein the product supply station comprises:

a product packaging system comprising:

a product pusher; and one or more product actuators operatively coupled to the product pusher;

wherein the one or more product actuators are configured to extend the product pusher to move the products to the mailers.

15. The mailer packaging apparatus of claim 1, further comprising:

the mailer closing station;

wherein the mailer closing station is configured to close an opening of the mailer after a product is inserted into the mailer.

16. The mailer packaging apparatus of claim 15, wherein the mailer closing station comprises:

an internal folding member positioned on an internal surface of a mailer;

an external folding member positioned on a first outer surface of the mailer; and a closing actuator operatively coupled to the external folding member;

wherein the external folding member is configured to engage the first outer surface of the mailer to fold a lip of the mailer around the internal folding member for operatively coupling the lip to a second outer surface of the mailer.

17. The mailer packaging apparatus of claim 1, further comprising:

a mailer discharge station;

wherein the mailer discharge station is configured to remove a packaged mailer from a mailer packaging station.

18. The mailer packaging apparatus of claim 17, wherein the mailer discharge station comprises:

a mailer pusher; and a mailer pusher actuator operatively coupled to the mailer pusher;

wherein the mailer pusher actuator is configured to discharge the packaged mailer from the mailer packaging station.

19. A method of packaging products in mailers using a mailer packaging apparatus, wherein the mailer packaging apparatus comprises a handling station having a robot, a mailer supply station having a plurality of magazines for holding the mailers, wherein the plurality of magazines are moveable with respect to the robot, and a packaging station comprising a plurality of mailer pockets configured to receive the mailers for packaging, the method comprising:

moving a first magazine of the plurality of magazines adjacent to the robot, wherein the first magazine is configured to hold a plurality of first mailers moving the robot to pick a first mailer from the first magazine adjacent to the robot; and moving the robot to deliver the first mailer to a mailer pocket of the plurality of mailer pockets of the packaging station and transfer the mailer pocket to a product supply station to receive a product and to a closing station after receiving the product from the product supply station.

* * * * *